US010379455B2

(12) United States Patent
Maeda

(10) Patent No.: US 10,379,455 B2
(45) Date of Patent: Aug. 13, 2019

(54) IMAGE FORMING APPARATUS

(71) Applicant: Katsuhiko Maeda, Kanagawa (JP)

(72) Inventor: Katsuhiko Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 15/876,498

(22) Filed: Jan. 22, 2018

(65) Prior Publication Data

US 2018/0267422 A1 Sep. 20, 2018

(30) Foreign Application Priority Data

Mar. 16, 2017 (JP) ..... 2017-051243

(51) Int. Cl.

| | |
|---|---|
| ***G03G 15/01*** | (2006.01) |
| ***G03G 21/14*** | (2006.01) |
| ***G03G 15/00*** | (2006.01) |
| ***G03G 15/16*** | (2006.01) |
| ***G03G 15/043*** | (2006.01) |
| *G03G 15/04* | (2006.01) |

(Continued)

(52) U.S. Cl.

CPC ..... *G03G 15/0173* (2013.01); *G03G 15/043* (2013.01); *G03G 15/167* (2013.01); *G03G 15/5062* (2013.01); *G03G 15/55* (2013.01); *G03G 15/0105* (2013.01); *G03G 15/04045* (2013.01); *G03G 15/05* (2013.01); *G03G 15/161* (2013.01); *G03G 15/2017* (2013.01)

(58) Field of Classification Search

CPC ..... G03G 15/0173; G03G 15/0105; G03G 15/04045; G03G 15/05; G03G 15/161; G03G 15/167; G03G 15/2017

See application file for complete search history.

(56) References Cited

U.S. PATENT DOCUMENTS

| | | | |
|---|---|---|---|
| 6,249,304 | B1 | 6/2001 | Sawayama et al. |
| 2004/0095454 | A1 | 5/2004 | Maeda |
| 2004/0239747 | A1 | 12/2004 | Maeda |

(Continued)

FOREIGN PATENT DOCUMENTS

| | | |
|---|---|---|
| JP | 9-314940 | 12/1997 |
| JP | 2000-305324 | 11/2000 |

(Continued)

*Primary Examiner* — David M. Gray
*Assistant Examiner* — Michael A Harrison
(74) *Attorney, Agent, or Firm* — Harness, Dickey & Pierce, P.L.C.

(57) ABSTRACT

An image forming apparatus includes: a photoconductor; an optical writer to write a latent image on the photoconductor; an image data generator to generate image data of at least one of text and image and of a correction pattern; a light emission controller to control a light source of the optical writer; a developing device to develop the latent image into a toner image; a transfer device to transfer the toner image onto a recording medium; a fixing device to fix the toner image thereon; a detector to detect the toner image of the correction pattern formed according to the image data; and a writing position controller to control when the light source emits light based on the toner image detected. The correction pattern is formed at each of four corners inside a margin of the recording medium, and includes two edges in each of main scanning and sub-scanning directions.

11 Claims, 20 Drawing Sheets

(51) Int. Cl.
*G03G 15/05* (2006.01)
*G03G 15/20* (2006.01)

(56) References Cited

U.S. PATENT DOCUMENTS

| | | | | |
|---|---|---|---|---|
| 2005/0200689 | A1 | 9/2005 | Shinohara et al. | |
| 2005/0207762 | A1* | 9/2005 | Funabiki ..... | G03G 15/5062 399/15 |
| 2006/0045577 | A1 | 3/2006 | Maeda | |
| 2007/0217831 | A1 | 9/2007 | Maeda | |
| 2008/0273902 | A1 | 11/2008 | Maeda | |
| 2014/0072317 | A1 | 3/2014 | Shukuya et al. | |
| 2015/0316870 | A1 | 11/2015 | Maeda | |
| 2016/0062296 | A1* | 3/2016 | Nakamura ..... | G03G 15/6558 399/15 |
| 2016/0275381 | A1 | 9/2016 | Maeda et al. | |

FOREIGN PATENT DOCUMENTS

| | | |
|---|---|---|
| JP | 2003-173109 | 6/2003 |
| JP | 2005-173261 | 6/2005 |
| JP | 2006-091179 | 4/2006 |
| JP | 2009-175446 | 8/2009 |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2017-051243, filed on Mar. 16, 2017, in the Japan Patent Office, the entire disclosure of which is hereby incorporated by reference herein.

BACKGROUND

Technical Field

Embodiments of the present disclosure relates to an image forming apparatus for forming an image on a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such image forming apparatuses may often perform duplex printing to form images on both front and back sides of the recording medium. The images may be sometimes formed at the same position on the front and back sides of the recording medium, with reliable double-sided image matching performance.

SUMMARY

In one embodiment of the present disclosure, a novel image forming apparatus includes at least one photoconductor, an optical writer, an image data generator, a light emission controller, a conveyor, a developing device, a transfer device, a fixing device, a detector, and a writing position controller. The optical writer includes a light source configured to emit light, to write an electrostatic latent image on the at least one photoconductor. The image data generator is configured to generate image data of at least one of text and image to be printed on a recording medium and image data of a correction pattern for image displacement correction. The light emission controller is configured to control the light source to cause the optical writer to form the electrostatic latent image corresponding to the image data generated by the image data generator. The conveyor is configured to convey the recording medium. The developing device is configured to develop the electrostatic latent image with toner, to form a toner image on the at least one photoconductor. The transfer device is configured to transfer the toner image from the at least one photoconductor onto the recording medium conveyed by the conveyor. The fixing device includes a fixing rotator and a pressure rotator. The fixing rotator is configured to press against a surface of the recording medium bearing the toner image. The pressure rotator is configured to press against the fixing rotator to form a fixing nip between the fixing rotator and the pressure rotator, through which the recording medium is conveyed. The fixing device is configured to fix the toner image onto the recording medium. The toner image includes a toner image of the correction pattern. The detector is disposed downstream from the fixing nip in a direction of conveyance of the recording medium to detect the toner image of the correction pattern fixed onto the recording medium. The writing position controller is configured to control a time when the light source emits light to correct a position at which the electrostatic latent image is written on the at least one photoconductor, based on the toner image of the correction pattern detected by the detector. The correction pattern is formed at each of at least four corners inside a margin adjacent to an end portion of the recording medium. The correction pattern includes at least two edges in each of a main scanning direction and a sub-scanning direction.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
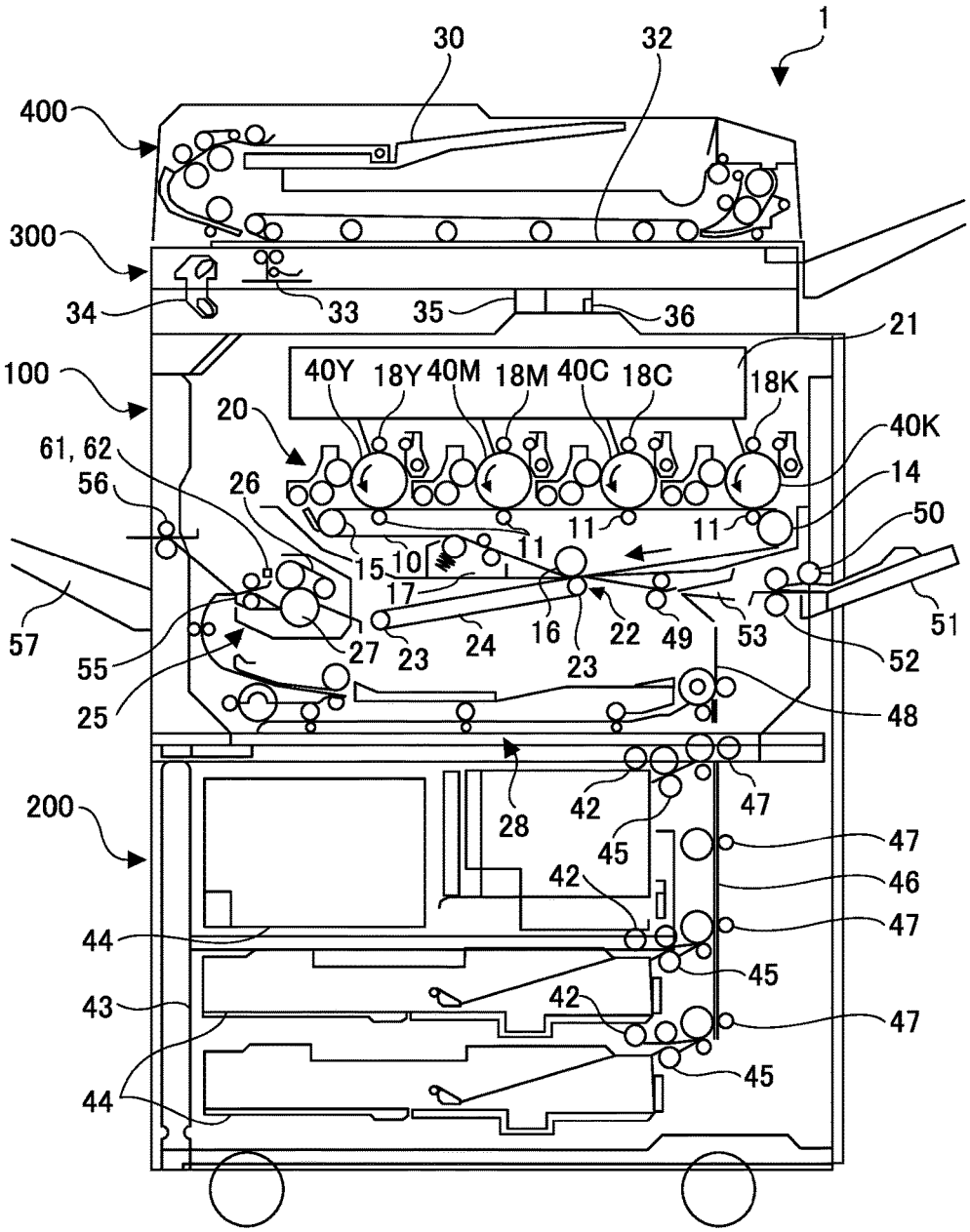
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, wherein like reference numerals designate identical or corresponding parts throughout the several views, embodiments of the present disclosure are described below.

Figure 2:
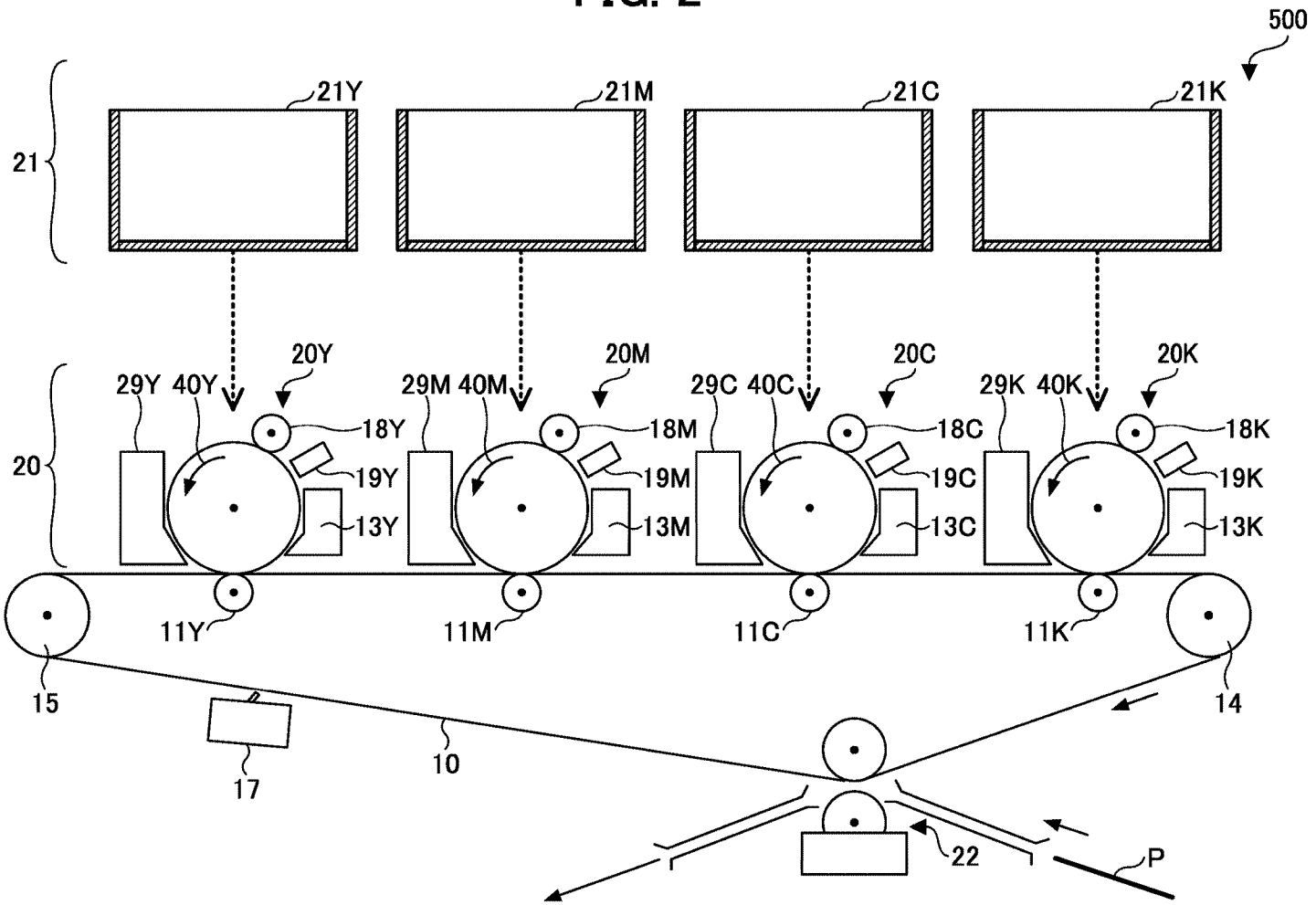
FIG. 2 is a schematic view of an image forming device incorporated in the image forming apparatus of FIG. 1.

Initially with reference to FIGS. 1 and 2, a description is given of an overall configuration of an image forming apparatus 1 according to an embodiment of the present disclosure.

FIG. 1 is a schematic view of the image forming apparatus 1. FIG. 2 is a schematic view of an image forming device 500 incorporated in the image forming apparatus 1.

The image forming apparatus 1 may be, e.g., a copier, a facsimile machine, a printer, a multifunction peripheral or a multifunction printer (MFP) having at least two of copying, printing, scanning, facsimile, and plotter functions. In the present embodiment, the image forming apparatus 1 is a color printer that forms color and monochrome images on recording media by electrophotography. The image forming apparatus 1 employs a tandem system in which a plurality of image forming units for forming toner images in different colors with a plurality of photoconductors is aligned in a direction in which a transfer belt is stretched. The image forming apparatus 1 also employs an intermediate transfer structure in which a toner image is transferred onto a recording medium via an intermediate transfer belt from a photoconductor.

Specifically, as illustrated in FIG. 1, the image forming apparatus 1 includes a printing device 100 serving as a printer unit, in which an intermediate transfer unit is disposed centrally. The intermediate transfer unit includes, e.g., an endless intermediate transfer belt 10 and four primary transfer devices 11Y, 11M, 11C, and 11K, specifically illustrated in FIG. 2, for colors yellow (Y), magenta (M), cyan (C), and black (K), respectively. The intermediate transfer belt 10, serving as an intermediate transferor, is entrained around a first support roller 14, a second support roller 15, and a third support roller 16. The intermediate transfer belt 10 is rotated in a clockwise direction in FIG. 1.

An intermediate transferor cleaner 17 is disposed downstream from the second support roller 15 in the direction of rotation of the intermediate transfer belt 10 to remove residual toner after a secondary transfer process. Specifically, the residual toner is toner that has failed to be transferred onto a sheet P serving as a recording medium during the secondary transfer process, and therefore remains on an outer circumferential surface of the intermediate transfer belt 10.

Above the intermediate transfer belt 10 is an image forming unit 20. Specifically, as illustrated in FIG. 2, the image forming unit 20 is constructed of four image forming units 20Y, 20M, 20C, and 20K that form toner images of yellow, magenta, cyan, and black, respectively. The image forming units 20Y, 20M, 20C, and 20K are arranged side by side along the direction of rotation of the intermediate transfer belt 10 between the first support roller 14 and the second support roller 15. Each of the image forming units 20Y, 20M, 20C, and 20K includes, e.g., a photoconductive drum 40 serving as a photoconductor, a charger 18, a developing device 29, a cleaner 13, and a discharger 19. The photoconductive drum 40 is surrounded by the charger 18, the developing device 29, the cleaner 13, and the discharger 19. As specifically illustrated in FIG. 2, the image forming unit 20Y includes, e.g., a photoconductive drum 40Y surrounded by a charger 18Y, a developing device 29Y, a cleaner 13Y, and a discharger 19Y. The image forming unit 20M includes, e.g., a photoconductive drum 40M surrounded by a charger 18M, a developing device 29M, a cleaner 13M, and a discharger 19M. The image forming unit 20C includes, e.g., a photoconductive drum 40C surrounded by a charger 18C, a developing device 29C, a cleaner 13C, and a discharger 19C. The image forming unit 20K includes, e.g., a photoconductive drum 40K surrounded by a charger 18K, a developing device 29K, a cleaner 13K, and a discharger 19K. The image forming unit 20 is removable from the image forming apparatus 1.

Above the image forming unit 20 is a light beam scanner 21 serving as an optical writer. The light beam scanner 21 irradiates each of the photoconductive drums 40 with laser light to form a latent image thereon.

Below the intermediate transfer belt 10 is a secondary transfer device 22. In the secondary transfer device 22, an endless secondary transfer belt 24 entrained around two secondary transfer rollers 23 pushes up the intermediate transfer belt 10 to press the intermediate transfer belt 10 against the third support roller 16.

A toner image is transferred from the intermediate transfer belt 10 onto the sheet P at an area of contact, herein referred to as a secondary transfer nip, between the secondary transfer belt 24 and the intermediate transfer belt 10. The sheet P, serving as a recording medium, is a paper sheet or the like. On a left side of the secondary transfer device 22 in FIG. 1 is a fixing device 25 that fixes the toner image, which has been transferred from the intermediate transfer belt 10, onto the sheet P. Specifically, the fixing device 25 includes, e.g., an endless fixing belt 26 and a pressure roller 27. The pressure roller 27 is pressed against the fixing belt 26, thereby forming an area of contact, herein referred to as a fixing nip, between the fixing belt 26 and the pressure roller 27. The sheet P bearing the toner image is conveyed to the fixing nip.

Figure 3:
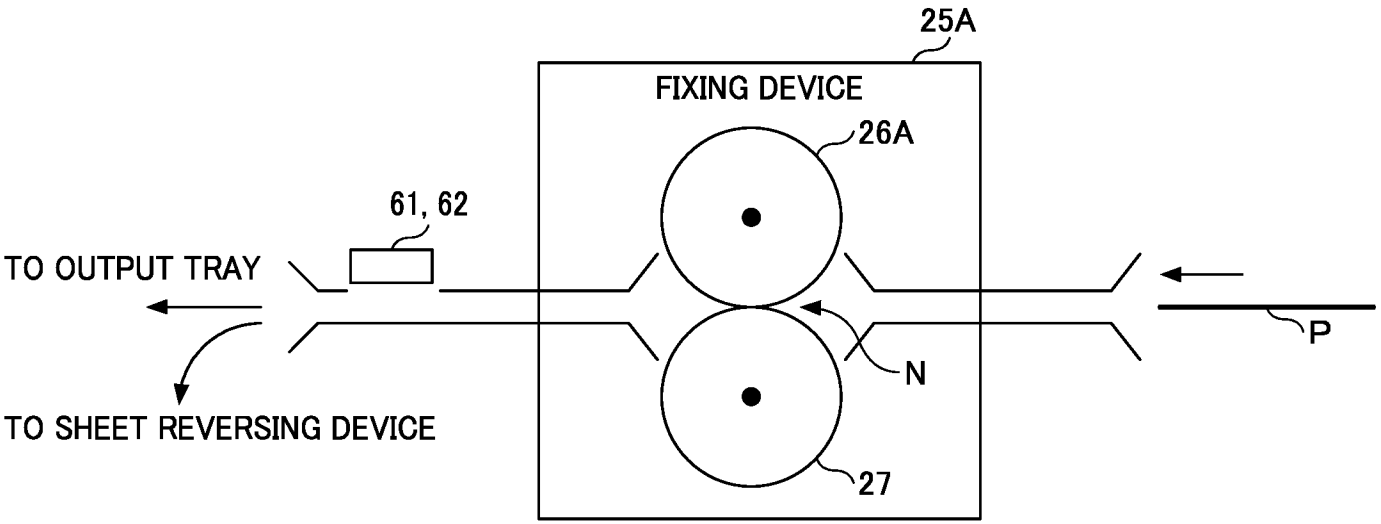
FIG. 3 is a schematic view of a fixing device and sensors disposed at an exit of the fixing device.

In the fixing device 25, the fixing belt 26 and the pressure roller 27 apply heat and pressure to the sheet P while the sheet P is conveyed therebetween. The heat applied to the sheet P causes toner contained in the toner image to melt and permeate the sheet P. Under the pressure applied to the sheet P, the toner image is fixed onto the sheet P. Note that FIG. 1 illustrates the fixing belt 26 as a fixing rotator having an outer circumferential surface to heat and fix the toner image onto the sheet P while the pressure roller 27 presses against the fixing belt 26. Alternatively, as illustrated in FIG. 3, a fixing roller 26A may be employed as the fixing rotator, instead of the fixing belt 26.

Below the secondary transfer device 22 and the fixing device 25 is a sheet reversing device 28 that reverses the sheet P immediately after the toner image is fixed onto the front side of the sheet P, so that another toner image is formed on the back side of the sheet P.

Figure 11:
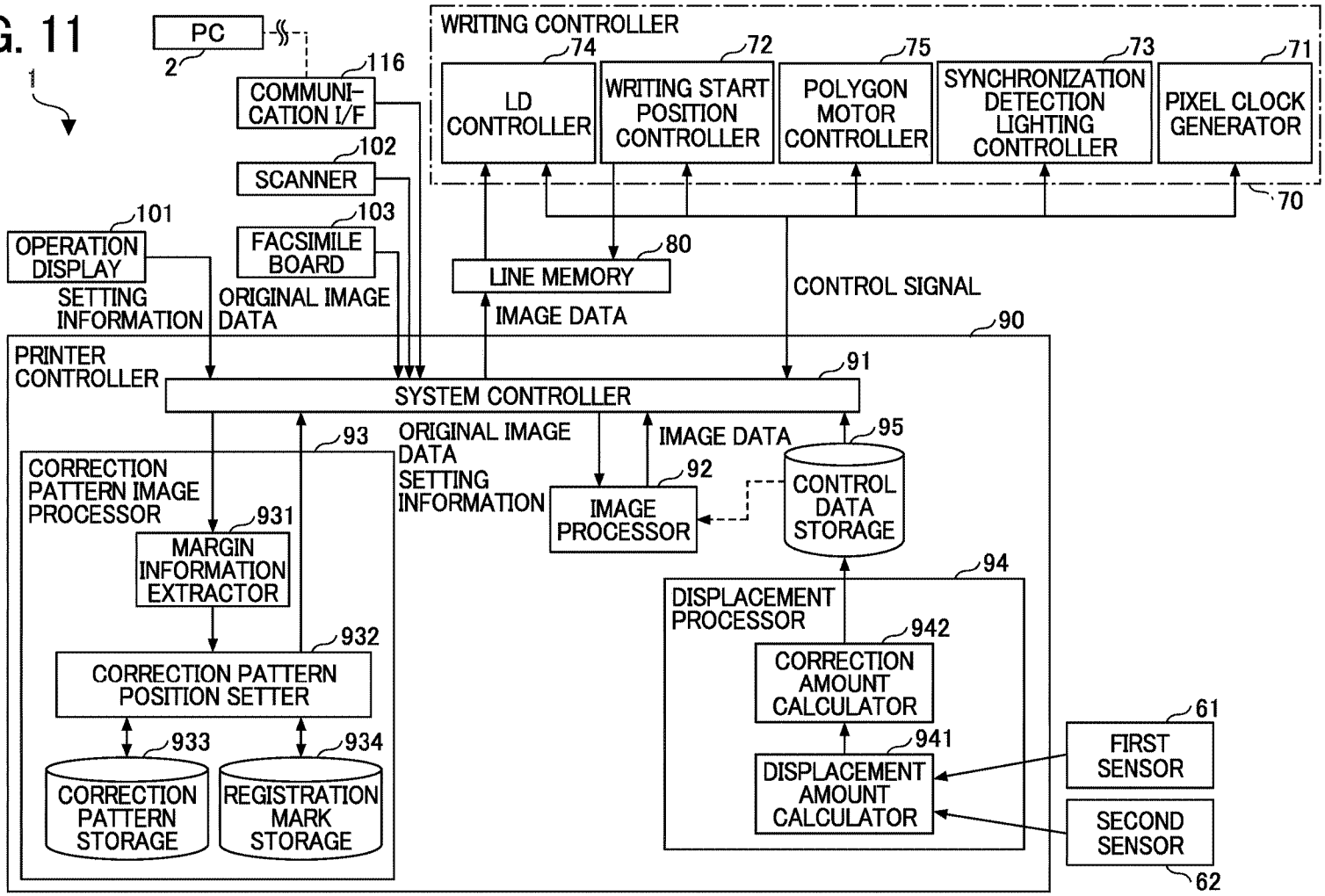
FIG. 11 is a functional block diagram of the image forming apparatus, particularly illustrating a part involved in correction pattern formation and image displacement detection in a printer controller.

The image forming apparatus 1 further includes an image reading device 300 and an automatic document feeder (ADF) 400 above the printing device 100. When a start switch or button on an operation display 101, illustrated in FIG. 11, is pressed, the ADF 400 conveys a document or an original from an ADF input tray 30 to an exposure glass 32. A scanner of the image reading device 300 is driven to read the original that reaches the exposure glass 32 or an original directly placed onto the exposure glass 32. Specifically, a first carriage 33 and a second carriage 34 are driven to scan the original.

The first carriage 33 carries, e.g., a light source and a first mirror. The light source emits light to the exposure glass 32. The light is reflected from the original surface and strikes the first mirror, which reflects the light toward the second carriage 34. A second mirror carried on the second carriage 34 reflects the light to a charge-coupled device (CCD) 36, serving as a reading or image sensor, via an imaging lens 35. Thus, the CCD 36 captures an image and generates an image signal by photoelectric conversion. According to the image signal, yellow, magenta, cyan, and black data are generated.

The intermediate transfer belt 10 is rotated, e.g., when the start button is pressed, when the image forming apparatus 1 receives an instruction to output an image from a personal computer (PC) 2, illustrated in FIG. 11, or when a facsimile board 103, illustrated in FIG. 11, receives facsimile data and directs to output an image. Meanwhile, the image forming unit 20 performs an image forming process. In other words, each of the image forming units 20Y, 20M, 20C, and 20K starts image forming operation. The components of each of the image forming units 20Y, 20M, 20C, and 20K start operation sequentially. Specifically, the charger 18 uniformly charges the surface of the photoconductive drum 40. The charged surface of the photoconductive drum 40 is irradiated with laser beams modulated according to the image data for each color. Thus, a latent image is formed on the surface of the photoconductive drum 40. The developing device 29 develops the latent image with toner, rendering the latent image visible as a toner image. Thus, toner images of yellow, magenta, cyan, and black are formed on the respective photoconductive drums 40Y, 40M, 40C, and 40K. The toner images are transferred onto the outer circumferential surface of the intermediate transfer belt 10 while being superimposed one atop another thereon. As a consequence, a composite toner image is formed on the intermediate transfer belt 10.

Activation of a registration roller pair 49 is timed to convey the sheet P to the secondary transfer device 22 such that a leading end of the sheet P enters the secondary transfer device 22 at the time when a leading end of the toner image on the intermediate transfer belt 10 enters the secondary transfer device 22. Thus, the secondary transfer device 22 transfers the toner image from the outer circumferential surface of the intermediate transfer belt 10 onto the sheet P. The sheet P bearing the toner image is conveyed to the fixing device 25. In the fixing device 25, the toner image is fixed onto the sheet P.

The image forming apparatus 1 further includes a sheet feeding device 200 below the printing device 100. The sheet feeding device 200 includes, e.g., a sheet feeding unit 43 in which sheet trays 44 are vertically disposed as illustrated in FIG. 1. A plurality of sheets P can be loaded onto the sheet trays 44. Each of the sheet trays 44 is provided with, e.g., a sheet feeding roller 42 and a separation roller 45. Conveyance of the sheet P starts with selectively rotating one of the sheet feeding rollers 42 to pick up the sheet P from the corresponding sheet tray 44. The separation roller 45 separates the sheet P from other sheets P one by one to direct the sheet P to a first conveyor roller unit 46. The sheet P entering the first conveyor roller unit 46 is conveyed by at least one of conveyor roller pairs 47 toward a second conveyor roller unit 48 that is disposed in the printing device 100. The second conveyor roller unit 48 includes, e.g., the registration roller pair 49 serving as a conveyor. When the sheet P abuts against the registration roller pair 49, the registration roller pair 49 temporarily halts the sheet P. Activation of the registration roller pair 49 is timed to send out the sheet P toward the secondary transfer device 22 such that the sheet P meets the toner image on the intermediate transfer belt 10 in the secondary transfer device 22.

Alternatively, the sheet or sheets P may be placed on a bypass tray 51, serving as a bypass feeder, and imported into the printing device 100. In such a case, the printing device 100 drives and rotates a sheet feeding roller 50 to pick up the sheet P from the bypass tray 51. A separation roller 52 separates the sheet P from other sheets P on the bypass tray 51 and directs the sheet P to a bypass conveyance passage 53. The sheet P is conveyed along the bypass conveyance passage 53 and abuts against the registration roller pair 49. Then, as described above, the registration roller pair 49 temporarily halts the sheet P and sends out the sheet P toward the secondary transfer device 22 such that the sheet P meets the toner image on the intermediate transfer belt 10 in the secondary transfer device 22.

As described above, the sheet P bearing the toner image is conveyed from the secondary transfer device 22 to the fixing device 25, which fixes the toner image onto the sheet P. A switching claw 55 guides the sheet P bearing the fixed toner image to an output roller 56 serving as a sheet ejecting roller. The output roller 56 ejects the sheet P onto an output tray 57. Thus, a plurality of sheet P lies stacked on the output tray 57. Alternatively, the switching claw 55 may guide the sheet P to the sheet reversing device 28. The sheet reversing device 28 reverses the sheet P, and then directs the reversed sheet P to the second conveyor roller unit 48, which conveys the sheet P to the secondary transfer device 22. The secondary transfer device 22 transfers another toner image from the intermediate transfer belt 10 onto the back side of the sheet P. The sheet P bearing the toner images on both sides is conveyed to the fixing device 25, which fixes the toner image onto the back side of the sheet P. The switching claw 55 guides the sheet P bearing the fixed toner images on both sides to the output roller 56, which ejects the sheet P onto the output tray 57.

With regard to the residual toner remaining on the intermediate transfer belt 10 after the secondary transfer process, the intermediate transferor cleaner 17 removes the residual toner from the outer circumferential surface of the intermediate transfer belt 10, rendering the intermediate transfer belt 10 ready for a next image formation.

Note that FIG. 1 illustrates the image forming apparatus 1 as a color image forming apparatus employing a tandem structure and an intermediate transfer structure. Alternatively, the image forming apparatus 1 may be a monochrome image forming apparatus that forms a monochrome image on a recording medium. Regardless of the type of the image forming apparatus (i.e., monochrome image forming apparatus or color image forming apparatus), the embodiments are also applicable to, e.g., the image forming apparatus that employs a single photoconductor and the image forming apparatus that employs a direct transfer structure in which a recording medium is transferred directly onto a recording medium from a photoconductor without an intermediate transfer belt.

Referring now to FIG. 2, a detailed description is given of the image forming device 500 incorporated in the printing device 100 of the image forming apparatus 1 described above.

FIG. 2 is a schematic view of the image forming device 500.

The image forming device 500 includes, e.g., the image forming unit 20 constructed of the image forming units 20Y, 20M, 20C, and 20K, and the light beam scanner 21 constructed of light beam scanners 21Y, 21M, 21C, and 21K, to superimpose toner images of four colors (i.e., yellow, magenta, cyan, black) one atop another, thereby forming a composite color toner image.

The light beam scanner 21 serves as an optical writer. Light beams from the light beam scanner 21 are incident on the image forming unit 20. A detailed description of the light beam scanner 21 will be described later with reference to FIG. 4.

The image forming unit 20 performs the image forming process based on the incident light beams. Generally, an electrophotographic image forming process includes five processes, namely, a charging process, an exposure process, a developing process, a transfer process, and a fixing process. The charging, exposure, developing and transfer processes are performed in the image forming unit 20 illustrated in FIG. 2.

The image forming unit 20 forms toner images of yellow, magenta, cyan, black on the intermediate transfer belt 10 in the image forming process. The toner images of yellow, magenta, cyan, black formed by the respective image forming units 20Y, 20M, 20C, and 20K are sequentially superimposed one atop another on the intermediate transfer belt 10. Thus, a composite color toner image is formed on the intermediate transfer belt 10.

The image forming operation starts with the charging process. In the charging process, the charger 18 charges the surface of the photoconductive drum 40.

Thereafter, the light beam scanner 21 irradiates the photoconductive drum 40 of the image forming unit 20 with a light beam modulated according to image data. That is, in the exposure process, an electrostatic latent image is formed on the charged surface of the photoconductive drum 40 with the light beam.

Thereafter, in the developing process, the developing device 29 attaches toner to the electrostatic latent image thus formed on the surface of the photoconductive drum 40, rendering the electrostatic latent image visible as a toner image. Thus, the toner image is formed on the surface of the photoconductive drum 40. The developing devices 29Y, 29M, 29C, and 29K are coupled to toner bottles that contain toner of yellow, magenta, cyan, and black, respectively. The toner is supplied to the developing device 29 from the toner bottle, so that the developing device 29 develops the electrostatic latent image with toner to form the toner image on the photoconductive drum 40.

Thereafter, in the transfer process, the primary transfer device 11 transfers the toner image from the photoconductive drum 40 onto the intermediate transfer belt 10 at an area of contact, herein referred to as a primary transfer nip, between the photoconductive drum 40 and the intermediate transfer belt 10. The primary transfer device 11, which is disposed opposite the photoconductive drum 40, sandwiches the intermediate transfer belt 10 together with the photoconductive drum 40, thereby forming the primary transfer nip.

After a toner image of a first color is formed on the intermediate transfer belt 10, toner images of second, third, and fourth colors are superimposed one atop another, thus being transferred onto the intermediate transfer belt 10. As a consequence, a composite color toner image is formed on the intermediate transfer belt 10. The above-described transfer process from the photoconductive drum 40 to the intermediate transfer belt 10 is referred to as a primary transfer process.

By contrast, the secondary transfer process refers to a process in which the secondary transfer device 22 transfers the color toner image from the intermediate transfer belt 10 onto the sheet P conveyed. The color toner image, constructed of superimposed toner images of four colors, is formed on the sheet P in the secondary transfer process.

After the primary transfer process from the photoconductive drum 40 to the intermediate transfer belt 10, the cleaner 13 removes residual toner from the surface of the photoconductive drum 40, thereby cleaning the surface of the photoconductive drum 40. In this case, the residual toner is toner that has failed to be transferred onto the intermediate transfer belt 10 during the primary transfer process, and therefore remains on the surface of the photoconductive drum 40. The discharger 19 discharges the surface of the photoconductive drum 40, rendering the surface of the photoconductive drum 40 ready for a next image formation.

On the other hand, after the secondary transfer process, the intermediate transferor cleaner 17 removes the residual toner from the outer circumferential surface of the intermediate transfer belt 10.

Note that FIG. 2 illustrates the image forming device 500 to form toner image in different colors. Alternatively, the image forming device 500 may be a monochrome image forming device that forms a black toner image only, if the image forming apparatus 1 is a monochrome image forming apparatus.

Referring now to FIG. 3, a detailed description is given of a fixing device 25A as a variation of the fixing device 25 described above.

FIG. 3 is schematic view of the fixing device 25A and first and second sensors 61 and 62 disposed at an exit of the fixing device 25A.

In the fixing device 25 of FIG. 1 or the fixing device 25A of FIG. 3, a fixing nip N is formed by a fixing rotator and a pressure rotator pressed against the fixing rotator. When the sheet P is conveyed through the fixing nip N, the pressure rotator is pressed against the fixing rotator via the sheet P while the fixing rotator heats and presses against a surface of the sheet P bearing the toner image. In the fixing device 25 of FIG. 1, the fixing belt 26 serves as the fixing rotator. In the fixing device 25A of FIG. 3, the fixing roller 26A serves as the fixing rotator. The pressure roller 27 serves as the pressure rotator.

The fixing rotator of the fixing device according to the present embodiment may be either the fixing belt 26 of FIG. 1 or the fixing roller 26A of FIG. 3.

At the fixing nip N of the fixing device 25 or the fixing device 25A having such a structure, the toner image on the sheet P enters the surface of the sheet P, thus being fixed thereto. In short, the fixing process is performed.

FIG. 3 illustrates the first sensor 61 and the second sensor 62 in the vicinity of the exit of the fixing device 25A. The first sensor 61 and the second sensor 62 detect a pattern image that is formed on the sheet P to correct an image displacement. The pattern image may be hereinafter referred to as an image displacement correction pattern. Specifically, the first sensor 61 and the second sensor 62 serve as detectors that is disposed downstream from the fixing nip N in a direction of conveyance of the sheet P, hereinafter referred to as a sheet conveyance direction, to detect a toner image of the image displacement correction pattern fixed onto the sheet P.

The first sensor 61 and the second sensor 62 are image reading sensors such as charge-coupled device (CCD) image sensors or contact image sensors (CISs).

The first sensor 61 and the second sensor 62 read the image displacement correction pattern formed at four corners of a printable area on the sheet P. That is, the first sensor 61 and the second sensor 62 are disposed at positions where the first sensor 61 and the second sensor 62 can detect the image displacement correction pattern.

Figures 5, 5A, 5B:
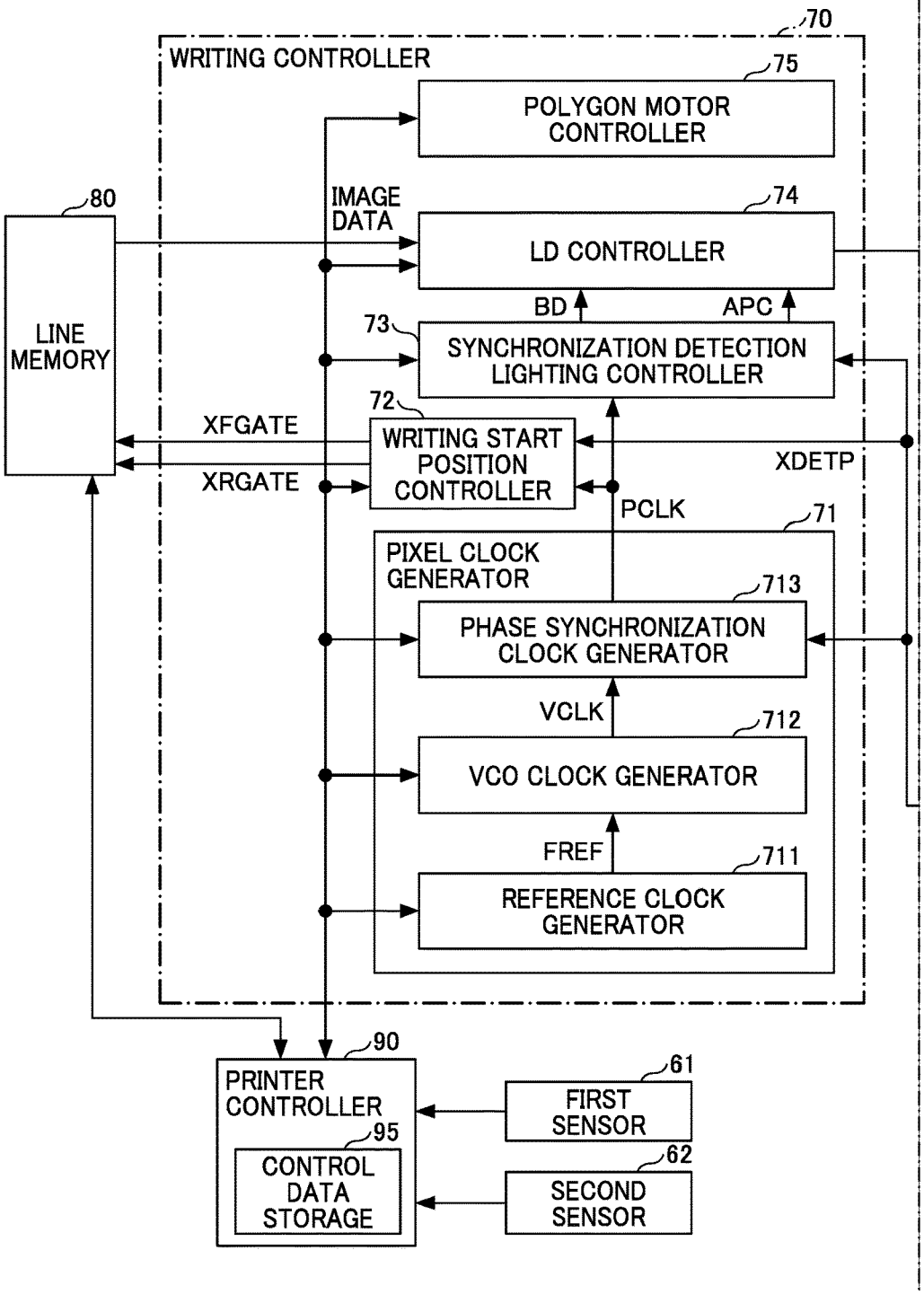
FIGS. 5A and 5B (collectively referred to as FIG. 5) are functional block diagrams of a writing controller and the light beam scanner incorporated in the image forming apparatus of FIG. 1.
Figure 5B:
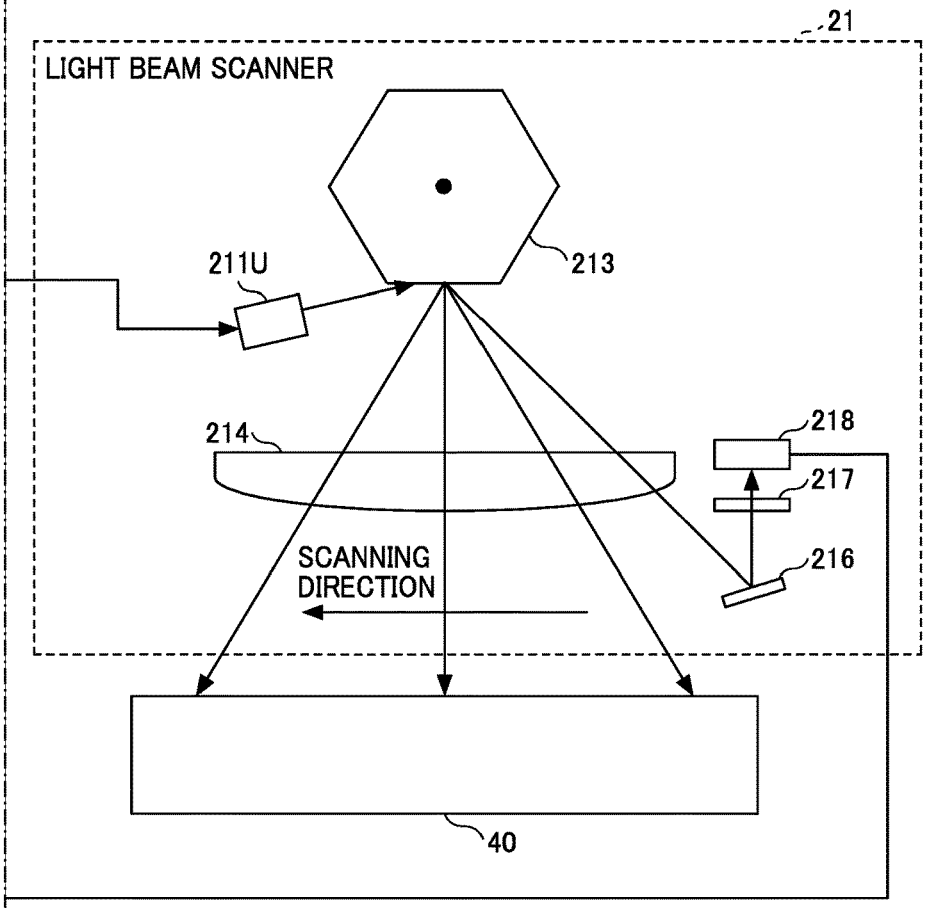

Based on readings of the first sensor 61 and the second sensor 62, that is, results of detection of the image displacement correction pattern fixed on the sheet P, a printer controller 90, illustrated in FIG. 5A, corrects an image position with respect to the sheet P and an image position on the back side of the sheet P with respect to an image position on the front side of the sheet P.

Figure 4:
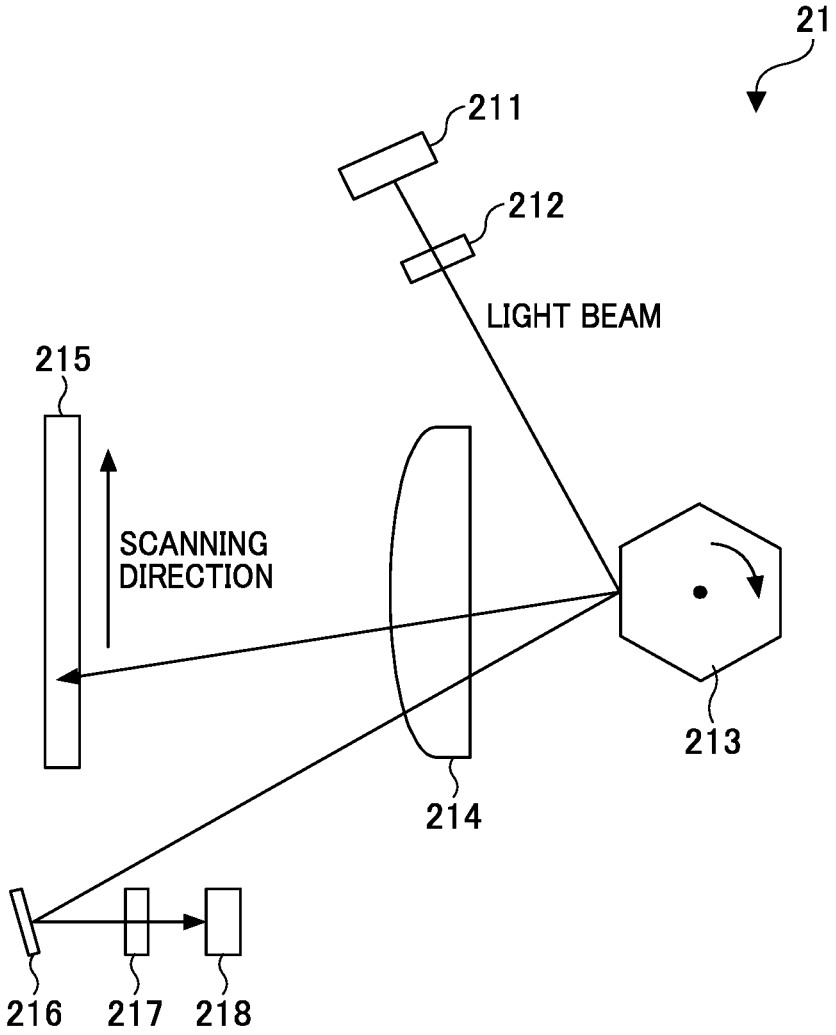
FIG. 4 is a top view of a light beam scanner incorporated in the image forming apparatus of FIG. 1.

Referring now to FIG. 4, a detailed description is given of the light beam scanner 21 incorporated in the image forming apparatus 1 described above.

FIG. 4 illustrates an example of the configuration of the light beam scanner 21. FIG. 4 is a top view of one of the light beam scanners 21Y, 21M, 21C, and 21K illustrated in FIG. 2.

Since the light beam scanners 21Y, 21M, 21C, and 21K have identical configurations, a description is given of the configuration of one of the light beam scanners 21Y, 21M, 21C, and 21K, as the configuration of the light beam scanner 21, with reference to FIG. 4.

The light beam scanner 21 includes a laser diode (LD) 211, a cylinder lens 212, a polygon mirror 213, an f-θ lens 214, a deflection mirror 215, a synchronization mirror 216, a synchronization lens 217, and a synchronization sensor 218.

In the present embodiment, the LD 211 is a light source that emits a light beam.

More specifically, the LD 211 is a light source that is turned on and turned off under control by a laser diode (LD) controller 74, illustrated in FIG. 5A, based on the image data inputted to the image forming apparatus 1. The light beam emitted from the LD 211 passes through the cylinder lens 212. The light beam is then reflected by the polygon mirror 213. The polygon mirror 213, rotated by a polygon motor, deflects the light beam striking the polygon mirror 213. Note that the light beam scanner 21 may include a plurality of LDs 211 or may include a light source shared by a plurality of colors.

The light beam reflected by the polygon mirror 213 passes through the f-θ lens 214 and heads for the deflection mirror 215. The deflection mirror 215 reflects the light beam toward the image forming unit 20. Accordingly, the photoconductive drums 40Y, 40M, 40C, and 40K of the respective image forming units 20Y, 20M, 20C, and 20K are irradiated with the light beams, thus being scanned.

At an end portion where writing an image starts in a main scanning direction, the synchronization mirror 216 reflects the light beam passing through the f-θ lens 214 toward the synchronization lens 217. The light beam passes through the synchronization lens 217 and reaches the synchronization sensor 218. The synchronization sensor 218, which may be referred to as a synchronization detecting sensor, detects when to start writing in the main scanning direction from the incident light beam, that is, the light beam reaching the synchronization sensor 218.

Note that the main scanning direction is a direction perpendicular to the sheet conveyance direction in which the sheet P is conveyed. A sub-scanning direction is a direction parallel to the sheet conveyance direction.

Referring now to FIGS. 5A and 5B, a description is given of a writing controller 70 and the light beam scanner 21 incorporated in the image forming apparatus 1 described above.

FIGS. 5A and 5B are functional block diagrams of the writing controller 70 and the light beam scanner 21.

Although FIGS. 5A and 5B illustrate a part involved in control of the light beam scanner 21 for one color, the writing controller 70, the light beam scanner 21, and the photoconductive drum 40 are disposed for each color, namely, yellow, magenta, cyan, and black, other than the printer controller 90 and the first and second sensors 61 and 62.

In FIGS. 5A and 5B, the printer controller 90 controls the writing controller 70. The writing controller 70 controls the light beam scanner 21. The printer controller 90 receives readings (i.e., detection results) of the first sensor 61 and the second sensor 62.

The writing controller 70 includes a pixel clock generator 71, a writing start position controller 72, a synchronization detection lighting controller 73, the LD controller 74 serving as a light emission controller, and a polygon motor controller 75. The synchronization detection lighting controller 73 is a lighting controller for detecting synchronization.

In the light beam scanner 21, the synchronization sensor 218 is disposed to detect the light beam on a writing start position side at the end portion in the main scanning direction where writing an image starts. As described above, in the light beam scanner 21, the light beam transmitted through the f-θ lens 214 is reflected by the synchronization mirror 216 and condensed by the synchronization lens 217, thereby reaching the synchronization sensor 218.

When the light beam passes over the synchronization sensor 218, the synchronization sensor 218 outputs and sends a synchronization detection signal XDETP to the pixel clock generator 71, the writing start position controller 72, and the synchronization detection lighting controller 73 of the writing controller 70.

The pixel clock generator 71 generates a pixel clock PCLK synchronized with the synchronization detection signal XDETP. The pixel clock generator 71 sends the pixel clock PCLK to the writing start position controller 72 and the synchronization detection lighting controller 73.

Specifically, the pixel clock generator 71 includes a reference clock generator 711, a voltage-controlled oscillator (VCO) clock generator 712, and a phase synchronization clock generator 713.

The reference clock generator 711 generates a reference clock signal FREF, which is a clock signal as a reference. The VCO clock generator 712 generates a voltage-controlled oscillator (VCO) clock signal VCLK. The phase synchronization clock generator 713 generates a pixel clock PCLK synchronized with the synchronization detection signal XDETP. Specifically, the phase synchronization clock generator 713 generates the pixel clock PCLK having a frequency changeable based on a frequency of the VCO clock signal VCLK.

A writing start position controller 72, serving as a writing position controller, generates a main scanning control signal XRGATE and a sub-scanning control signal XFGATE to determine when to start writing an image and an image width according to the synchronization detection signal XDETP, the pixel clock PCLK, a control signal from the printer controller 90, and the like.

To firstly detect the synchronization detection signal XDETP, the synchronization detection lighting controller 73 turns on a laser diode (LD) forced lighting signal BD such that the LD 211 is forced to emit light. On the other hand, after the synchronization detection lighting controller 73 detects the synchronization detection signal XDETP, the LD 211 is timed to emit light such that the synchronization detection signal XDETP can be reliably detected so as not to generate flare light, by use of the synchronization detection signal XDETP and the pixel clock PCLK. Then, the synchronization detection lighting controller 73 generates the LD forced lighting signal BD to turn off the LD 211 after detecting the synchronization detection signal XDETP. The synchronization detection lighting controller 73 then sends the LD forced lighting signal BD to the LD controller 74.

In addition, the synchronization detection lighting controller 73 generates a light amount control timing signal APC for the LD 211 for each color, with the synchronization detection signal XDETP and the pixel clock PCLK. The synchronization detection lighting controller 73 then sends the light amount control timing signal APC to the LD controller 74. The light amount control timing signal APC is executed outside an image writing area. At the time of executing the light amount control timing signal APC, the light amount is controlled to a target light amount.

The LD controller 74 controls lighting of the LD 211 according to the LD forced lighting signal BD, the light amount control timing signal APC, and image data synchronized with the pixel clock PCLK. Then, a laser beam is emitted from the LD 211 of a laser diode (LD) unit 211U, which includes the LD 211 and the cylinder lens 212, toward the polygon mirror 213. The polygon mirror 213 deflects the laser beam toward the photoconductive drum 40 via the f-θ lens 214. Thus, the surface of the photoconductive drum 40 is scanned with laser beam.

The polygon motor controller 75 controls rotation of the polygon motor according to a control signal from the printer controller 90. Specifically, the polygon motor controller 75 controls the polygon motor such that the polygon motor rotates at a predetermined number of rotation or a predetermined rotation speed. The polygon motor controller 75 controls the number of rotation or rotation speed of the polygon motor to change image magnification in the sub-scanning direction, for example. If it is difficult to control the number of rotation or rotation speed of the polygon motor for each page on which an image is printed, the polygon motor controller 75 thins out or inserts the image data, for example, so as to control the image magnification in the sub-scanning direction.

As described above, the first sensor 61 and the second sensor 62 that detect the image displacement correction pattern. Each of the first sensor 61 and the second sensor 62 detects and sends image pattern data to the printer controller 90.

The printer controller 90 calculates an amount of displacement, generates correction data, and sets control signals to the writing start position controller 72 and the pixel clock generator 71. The printer controller 90 stores the correction data in a control data storage 95.

When an image forming operation is performed, the correction data is retrieved from the control data storage 95 of the printer controller 90 in response to an instruction from a system controller 91, illustrated in FIG. 11, of the printer controller 90. A control signal corresponding to the correction data is set to the writing start position controller 72 and the pixel clock generator 71.

Figure 6:
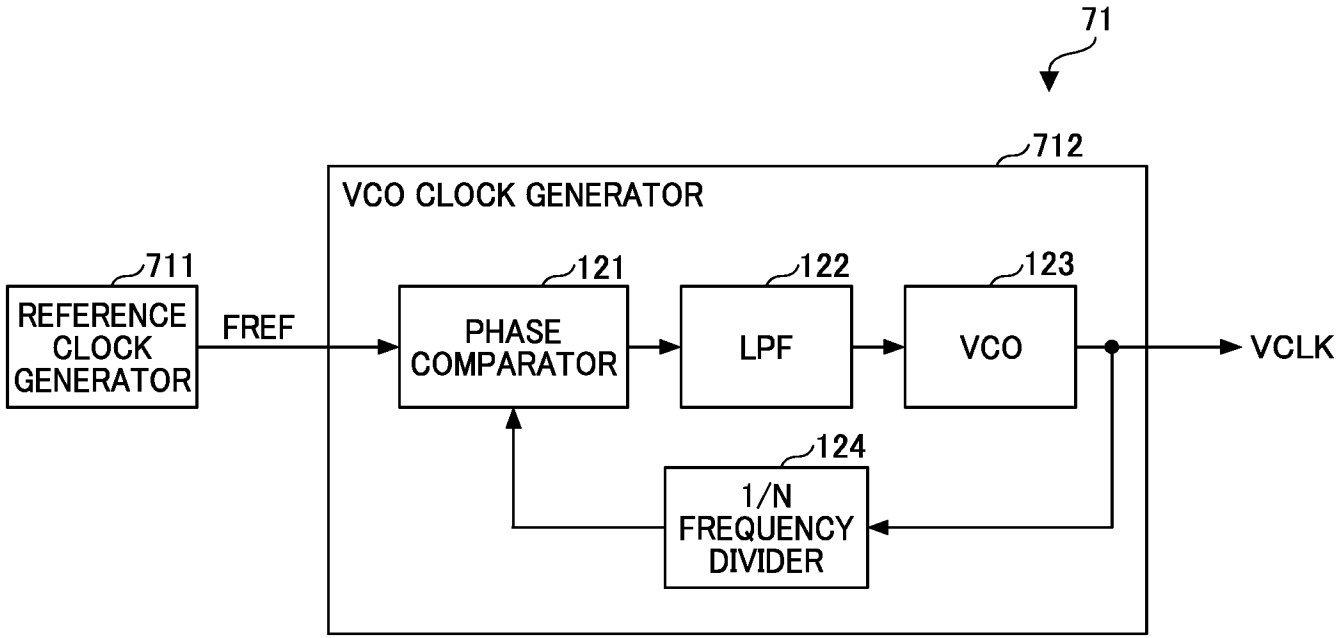
FIG. 6 is a functional block diagram of a voltage-controlled oscillator (VCO) clock generator incorporated in the writing controller of FIG. 5A.

Referring now to FIG. 6, a description is given of the VCO clock generator 712 incorporated in the pixel clock generator 71 of the writing controller 70.

FIG. 6 is a functional block diagram of the VCO clock generator 712.

The VCO clock generator 712 of FIG. 6 includes a phase comparator 121, a low pass filter (LPF) 122, a voltage-controlled oscillator (VCO) 123, and a 1/N frequency divider 124.

The phase comparator 121 receives the reference clock signal FREF from the reference clock generator 711 and the VCO clock signal VCLK having a 1/N frequency from the 1/N frequency divider 124. The phase comparator 121 compares phases of falling edges of the two input signals (i.e., the reference clock signal FREF and the VCO clock signal VCLK). The phase comparator 121 then outputs an error component to the LPF 122 with a predetermined current.

The LPF 122 removes, e.g., noise as a high frequency component from the output of the phase comparator 121. The LPF 122 then outputs a direct current (DC) voltage to the VCO 123.

Based on the output of the LPF 122, the VCO 123 outputs the VCO clock signal VCLK having an oscillation frequency depending on the output of the LPF 122.

The 1/N frequency divider 124 divides the frequency of the input VCO clock signal VCLK by a predetermined frequency division ratio N.

Note that the frequency of the reference clock signal FREF and the frequency division ratio N can be set with the printer controller 90. The pixel clock generator 71 changes the frequency of the reference clock signal FREF and the value of the frequency division ratio N, thereby changing the frequency of the VCO clock signal VCLK.

Figure 7:
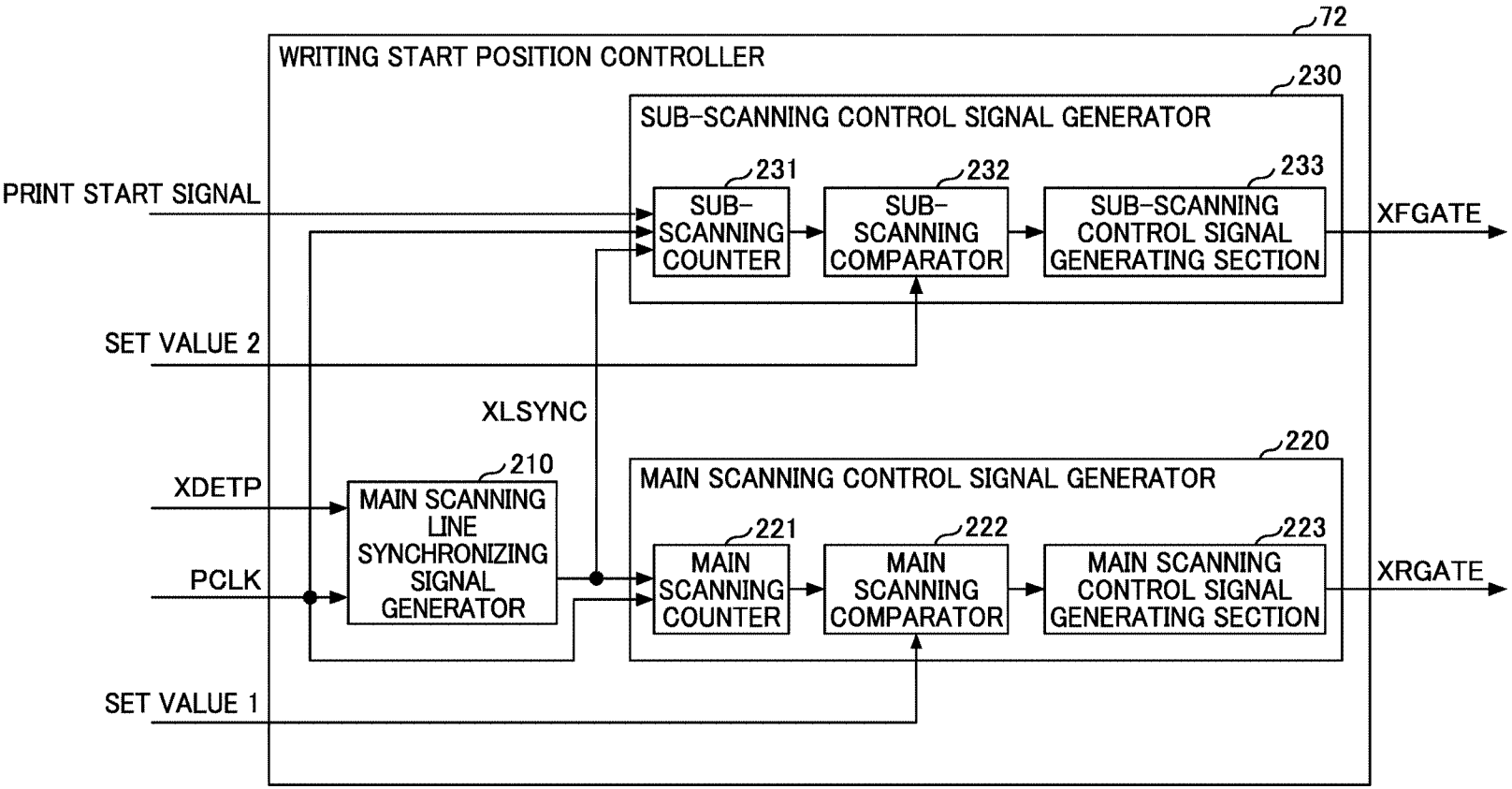
FIG. 7 is a functional block diagram of a writing start position controller incorporated in the writing controller of FIG. 5A.

Referring now to FIG. 7, a description is given of the writing start position controller 72 incorporated in the writing controller 70.

FIG. 7 is a functional block diagram of the writing start position controller 72.

The writing start position controller 72 of FIG. 7 includes a main scanning line synchronizing signal generator 210, a main scanning control signal generator 220, and a sub-scanning control signal generator 230.

The main scanning line synchronizing signal generator 210 generates a counter control signal XLSYNC for operating a main scanning counter 221 or a main scanning counter value in the main scanning control signal generator 220, and a sub-scanning counter 231 or a sub-scanning counter value in the sub-scanning control signal generator 230.

The main scanning control signal generator 220 generates the main scanning control signal XRGATE to determine when to capture an image signal, that is, when to start writing an image in the main scanning direction. The main scanning control signal generator 220 includes the main scanning counter 221, a main scanning comparator 222, and a main scanning control signal generating section 223.

In the main scanning control signal generator 220, the main scanning counter 221 starts its operation with the counter control signal XLSYNC to count up for each pixel clock signal PCLK. The main scanning comparator 222 compares the counter value of the main scanning counter 221, that is, a value counted by the main scanning counter 221, with a first set value (i.e., "set value 1" illustrated in FIG. 7) according to a setting signal from the printer controller 90. The main scanning comparator 222 then outputs a comparison result. The main scanning control signal generating section 223 generates the main scanning control signal XRGATE based on the comparison result from the main scanning comparator 222.

The sub-scanning control signal generator 230 generates the sub-scanning control signal XFGATE to determine when to capture an image signal, that is, when to start writing an image in the sub-scanning direction. The sub-scanning control signal generator 230 includes the sub-scanning counter 231, a sub-scanning comparator 232, and a sub-scanning control signal generating section 233.

In the sub-scanning control signal generator 230, the sub-scanning counter 231 starts its operation with a print start signal from the printer controller 90 to count up for each counter control signal XLSYNC. The sub-scanning comparator 232 compares the counter value of the sub-scanning counter 231, that is, a value counted by the sub-scanning counter 231, with a second set value (i.e., "set value 2" illustrated in FIG. 7) according to a setting signal from the printer controller 90. The sub-scanning comparator 232 then outputs a comparison result. The sub-scanning control signal generating section 233 generates the sub-scanning control signal XFGATE based on the comparison result from the sub-scanning comparator 232.

With respect to the main scanning, the writing start position controller 72 having a configuration described above corrects a writing position on a per cycle basis of the pixel clock PCLK, that is, on a per dot basis. By contrast, with respect to the sub-scanning, the writing start position controller 72 corrects a writing position on a per cycle basis of the counter control signal XLSYNC, that is, on a per line basis.

Note that, the corrected data both in the main scanning direction and in the sub-scanning direction are stored in the control data storage 95.

Figure 8:
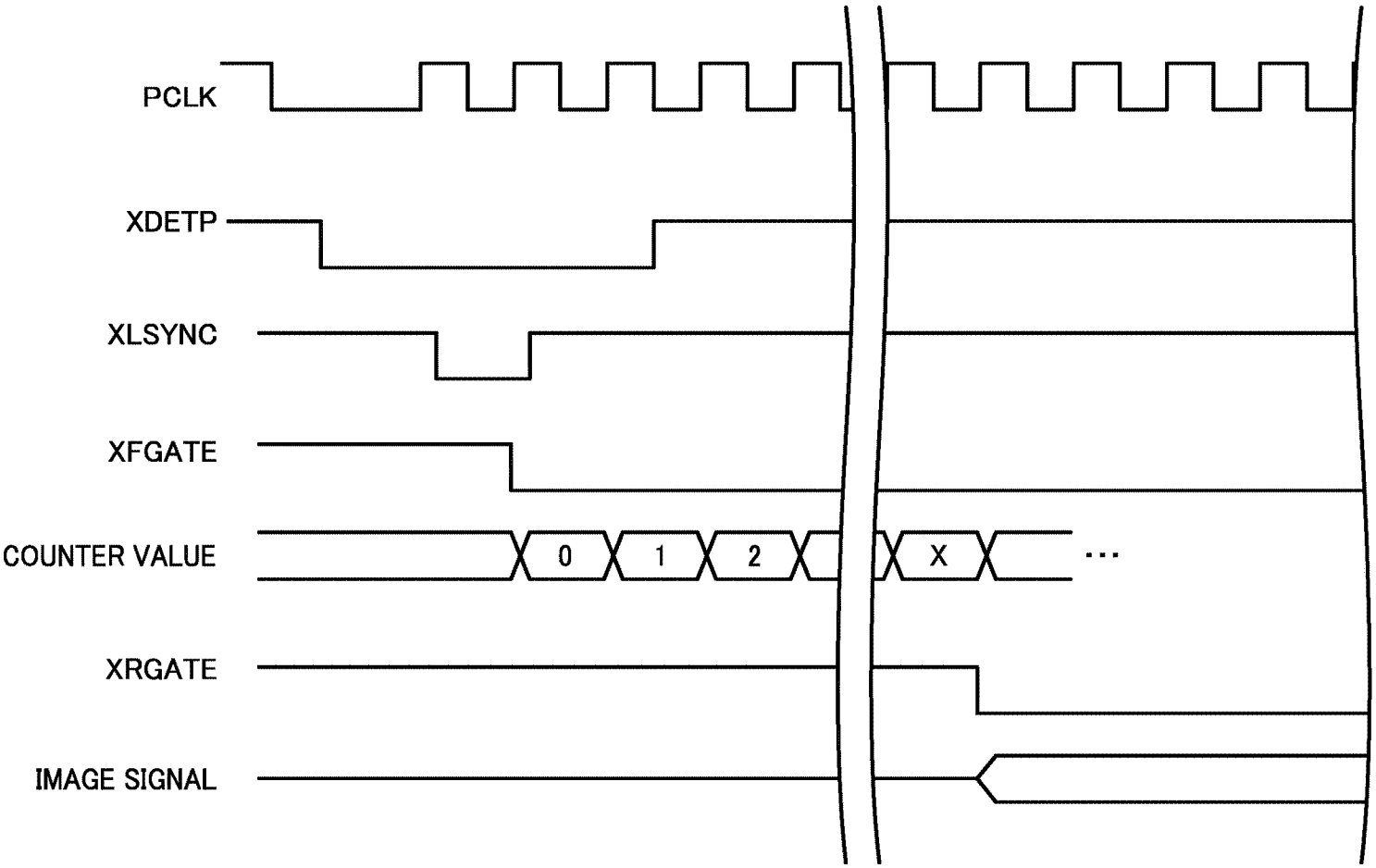
FIG. 8 is a timing chart illustrating an example of control executed by the writing start position controller of FIG. 7 in a main scanning direction.

Referring now to FIG. 8, a description is given of control executed by the writing start position controller 72 in the main scanning direction.

FIG. 8 is a timing chart illustrating an example of the control executed by the writing start position controller 72 in the main scanning direction.

In the present example of FIG. 8, the main scanning counter 221 resets the counter value with the counter control signal XLSYNC, and counts up the counter value with the pixel clock signal PCLK.

When the counter value (i.e., value counted by the main scanning counter 221) reaches the first set value (i.e., "X" illustrated in FIG. 8) set by the printer controller 90, the main scanning comparator 222 outputs the comparison result to the main scanning control signal generating section 223. The main scanning control signal generating section 223 outputs an effective, low-level main scanning control signal XRGATE. The main scanning control signal XRGATE is a low active signal, which is at a low level for an image width in the main scanning direction. That is, while the main scanning control signal XRGATE is low, a line memory 80, illustrated in FIG. 5A, outputs an image signal in the main scanning direction. The LD controller 74 causes the LD 211 of the light beam scanner 21 to irradiate the surface of the photoconductive drum 40 with light in the main scanning direction.

Figure 9:
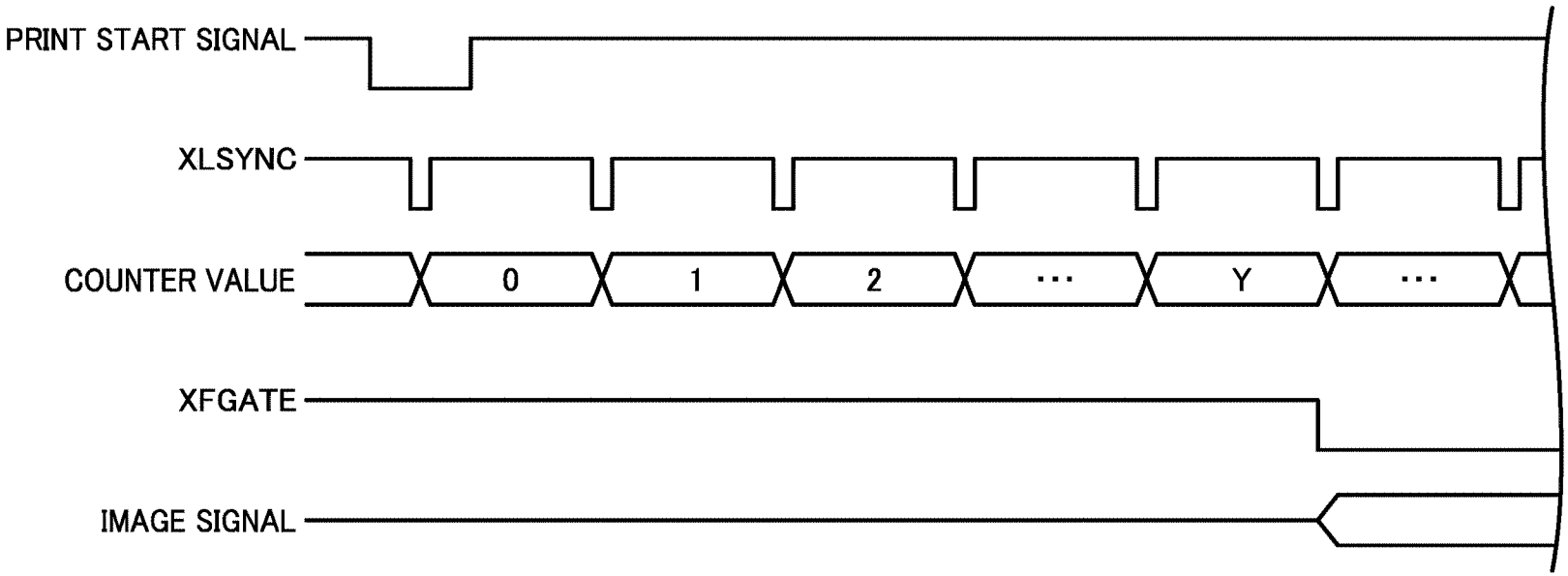
FIG. 9 is a timing chart illustrating an example of control executed by the writing start position controller of FIG. 7 in a sub-scanning direction.

Referring now to FIG. 9, a description is given of control executed by the writing start position controller 72 in the sub-scanning direction.

FIG. 9 is a timing chart illustrating an example of the control executed by the writing start position controller 72 in the sub-scanning direction.

In the present example of FIG. 9, the sub-scanning counter 231 resets the counter value with the print start signal from the printer controller 90, and counts up the counter value with the counter control signal XLSYNC.

When the counter value (i.e., value counted by the sub-scanning counter 231) reaches the second set value (i.e., "Y" illustrated in FIG. 9) set by the printer controller 90, the sub-scanning comparator 232 outputs the comparison result to the sub-scanning control signal generating section 233. The sub-scanning control signal generating section 233 outputs an effective, low-level sub-scanning control signal XFGATE.

The sub-scanning control signal XFGATE is a low active signal, which is at a low level for an image length in the sub-scanning direction. That is, while the sub-scanning control signal XFGATE is low, the line memory 80 outputs an image signal in the sub-scanning direction. The LD controller 74 causes the LD 211 of the light beam scanner 21 to irradiate the surface of the photoconductive drum 40 with light in the sub-scanning direction.

Figure 10:
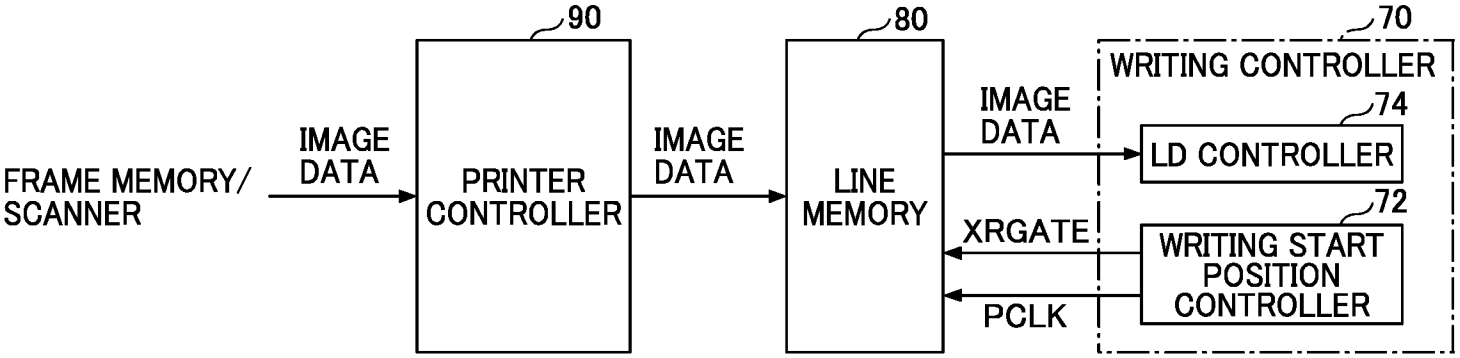
FIG. 10 is a functional block diagram of a structure for capturing an image signal.

Referring now to FIG. 10, a description is given of capturing an image signal.

FIG. 10 is a functional block diagram of a structure for capturing an image signal.

The image forming apparatus 1 includes the line memory 80 that is connected to the printer controller 90 and the writing controller 70. The line memory 80 stores image data inputted in the form of image signal.

The line memory 80 outputs the image signal in synchronization with the pixel clock signal PCLK inputted. The line memory 80 outputs the image signal to the LD controller 74 based on the main scanning control signal XRGATE inputted.

In short, the line memory 80 performs processing prior to the LD controller 74. Specifically, the printer controller 90 receives image data or image signals from a frame memory or a scanner (e.g., scanner 102 illustrated in FIG. 11), and outputs the image signals to the line memory 80. The line memory 80 stores and outputs the image signals, illustrated at the lowest in FIGS. 8 and 9, to the LD controller 74. The LD controller 74 turns on the LD 211 of FIG. 4 according to the image signals inputted from the line memory 80.

Referring now to FIG. 11, a description is given of a structure of the printer controller 90.

FIG. 11 is a functional block diagram of the image forming apparatus 1, particularly illustrating a part involved in correction pattern formation and image displacement detection in the printer controller 90.

The printer controller 90 includes the system controller 91, an image processor 92, a correction pattern image processor 93, a displacement processor 94, and the control data storage 95.

Setting information is input from the operation display 101 to the system controller 91 of the printer controller 90. The system controller 91 outputs the setting information to the image processor 92 and the correction pattern image processor 93.

On the other hand, original image data is transmitted to the system controller 91 from, e.g., the scanner 102, the facsimile board 103 (i.e., facsimile), or the PC 2 via a communication interface (I/F) 116 through a cable or radio communication. The system controller 91 outputs the original image data to the image processor 92 and the correction pattern image processor 93.

The correction pattern image processor 93 includes a margin information extractor 931, a correction pattern position setter 932, a correction pattern storage 933, and a registration mark storage 934.

The correction pattern storage 933 stores image data of one or more types and sizes of correction patterns in advance.

The registration mark storage 934 stores image data of at least one registration mark in advance. Note that the registration mark is a mark for a post process. For example, the registration mark may be used for multicolor printing, for precisely cutting a recording medium, or for precisely aligning images on opposite sides of a recording medium upon duplex printing.

The margin information extractor 931 extracts margin information, which is given to image data, from the original image data inputted from the scanner 102, the facsimile board 103, or the PC 2 having wired or wireless connection with the image forming apparatus 1. Specifically, as will be described in detail with reference to FIGS. 15A through 15C, the margin information extractor 931 first checks the original image data to determine whether a blank portion is present other than a print portion in the printable area. Note that the print portion is a portion where a toner image forming at least one of text and image is attached while the blank portion is a portion where no image is printed on the image data.

In some cases, the system controller 91 may output an instruction to forcibly give an inner margin inside an outer margin that is adjacent to an end portion of the sheet P. Hereinafter, the outer margin may be simply referred to as a margin.

If the margin information extractor 931 determines that, in the printable area, the black portion is present where no image is printed on the image data, then, the margin information extractor 931 extracts the margin information including a range of the margin (i.e., outer margin).

In no margin is set, the system controller 91 may output an instruction to forcibly set a margin. If there is no blank space (e.g., inner margin) inside the printable area and no margin (e.g., outer margin) is set, the system controller 91 may output an instruction to forcibly set the inner and outer margins.

The correction pattern position setter 932 sets image data of an image displacement correction pattern selected from the correction patterns stored in the correction pattern storage 933 such that the image displacement correction pattern is formed immediately adjacent to a border or an outer frame of the printable area or print area, which is located inside the margin (i.e., outer margin) acquired by the margin information extractor 931 on a sheet P.

Upon formation of a registration mark, the correction pattern position setter 932 generates image data of the registration mark acquired from the registration mark storage 934 such that the registration mark is formed immediately adjacent to the border of the printable area or print area, which is located inside the margin (i.e., outer margin) acquired by the margin information extractor 931 on a sheet P. The correction pattern position setter 932 then generates the image data of the image displacement correction pattern in an area in which the registration mark is formed.

Then, the correction pattern position setter 932 transfers the image data of the image displacement correction pattern thus generated to the system controller 91, together with the image data of the registration mark for formation of the registration mark.

As illustrated in FIG. 11, the image processor 92 performs image processing on the original image or original image data to generate image data. The image processor 92 and the correction pattern image processor 93 function as an image data generator.

Upon printing, the system controller 91 outputs the image data thus generated by the image processor 92 to the LD controller 74 of the writing controller 70 via the line memory 80, together with the image data of the correction pattern and the image data of the registration mark for formation of the registration mark, both of which are generated by the correction pattern image processor 93.

The displacement processor 94 includes a displacement amount calculator 941 and a correction amount calculator 942.

The displacement amount calculator 941 calculates an input amount of displacement from the readings of the first sensor 61 and the second sensor 62, that is, the position of the correction pattern detected by the first sensor 61 and the second sensor 62. Specifically, the displacement amount calculator 941 compares the readings with an ideal value, thereby calculating the displacement amount (i.e., input amount of displacement) with respect to the ideal value. In other words, the displacement amount calculator 941 calculates how much the position of the correction pattern deviates from an ideal position. The displacement amount calculator 941 then determines whether correction is to be performed. For example, if the displacement amount is equal to or greater than half a correction resolution, the displacement amount calculator 941 determines that correction is to be performed.

If the displacement amount calculator 941 determines that correction is to be performed, then, the correction amount calculator 942 calculates an image position in the main scanning direction, image magnification, an image position in the sub-scanning direction, and a correction value of the image magnification, based on the displacement amount calculated by the displacement amount calculator 941.

Note that the image position in the main scanning direction, the image magnification, the image position in the sub-scanning direction, and the correction value of the image magnification thus calculated by the correction amount calculator 942 are herein collectively referred to as control data. Then, the correction amount calculator 942 stores the control data in the control data storage 95.

The system controller 91 retrieves the control data from the control data storage 95 as appropriate to output the control data as control signals to the writing start position controller 72, the pixel clock generator 71, and the polygon motor controller 75 of the writing controller 70.

Figure 12:
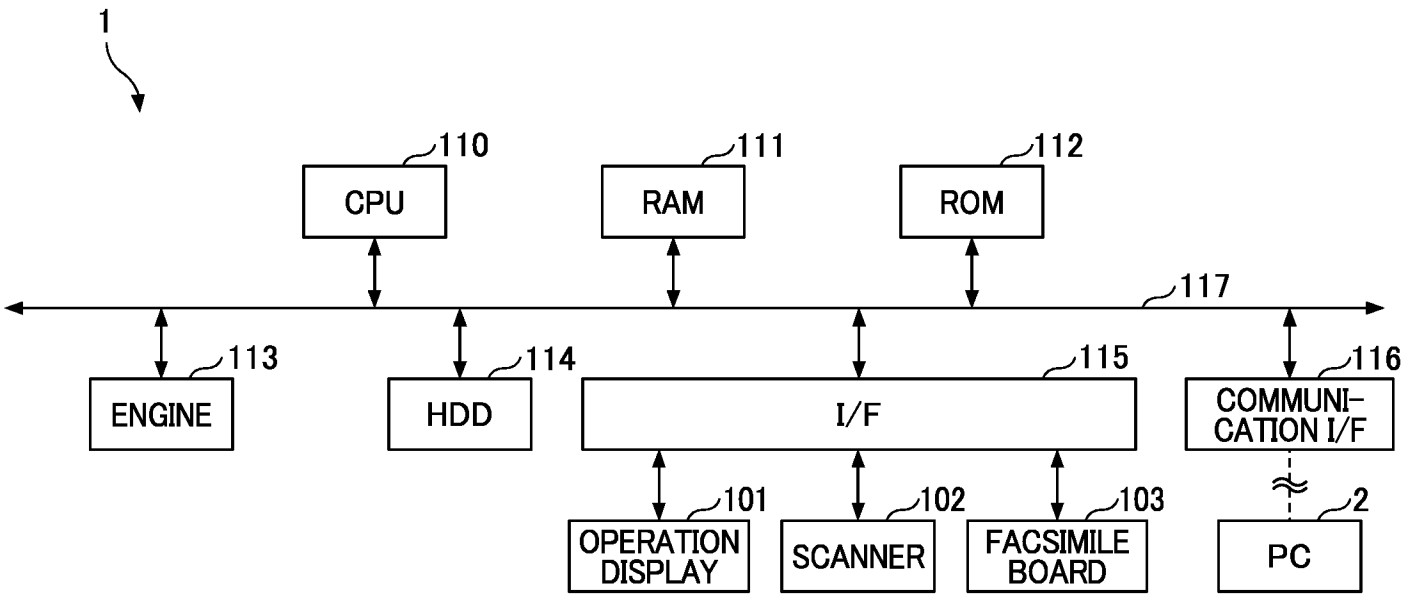
FIG. 12 is a block diagram of a hardware structure of the image forming apparatus.

Referring now to FIG. 12, a description is given of a hardware structure of the image forming apparatus 1.

FIG. 12 is a block diagram of the hardware structure of the image forming apparatus 1.

In the present embodiment, the image forming apparatus 1 includes an engine 113 that executes image formation, in addition to the configuration similar to the configuration of a general server or an information processing terminal such as a personal computer (PC).

As illustrated in FIG. 12, the image forming apparatus 1 includes, e.g., a central processing unit (CPU) 110, a random access memory (RAM) 111, a read only memory (ROM) 112, the engine 113, a hard disk drive (HDD) 114, an interface (I/F) 115, and the communication I/F 116, which are connected to each other via a bus 117.

The I/F 115 is connected with the operation display 101, the scanner 102, and the facsimile board 103.

The CPU 110 is a calculator or computing device that controls overall operation of the image forming apparatus 1. The RAM 111 is a volatile storage medium capable of high-speed reading and writing of information. When the CPU 110 processes information, the RAM 111 is used as a work area of the CPU 110. The ROM 112 is a read-only, non-volatile storage medium that stores programs such as firmware.

The engine 113 is a mechanism that actually executes image formation in the image forming apparatus 1. For example, the engine 113 corresponds to the printing device 100 illustrated in FIG. 1. The engine 113 includes a drive controller for, e.g., the light beam scanner 21, the image forming unit 20, a toner supply mechanism that supplies toner to the developing device 29 from the toner bottle, a sheet feeding and conveying mechanism (e.g., first conveyor roller unit 46, conveyor roller pairs 47), transfer devices (e.g., intermediate transfer belt 10, primary transfer devices 11, secondary transfer device 22), and the fixing device 25.

The HDD 114 is a nonvolatile storage medium capable of reading and writing information. The HDD 114 stores, e.g., an operating system (OS), and various kinds of control programs and application programs.

The I/F 115 connects the bus 117 and various types of hardware for control of the connection.

The operation display 101 includes a liquid crystal display (LCD) as a visual user interface that causes, e.g., a user to confirm conditions of the image forming apparatus 1, and a user interface such as a keyboard and a mouse with which the user inputs information to the image forming apparatus 1.

The scanner 102 reads an image (i.e., print information) of an original placed on the exposure glass 32 or an original set on the ADF 400. The scanner 102 then converts the image thus read into image data (i.e., electric signal).

In response to a facsimile transmission instruction, the facsimile board 103 drives the scanner 102 to read an image of an original, thereby transmitting the image data to a facsimile communication line. Upon reception of a facsimile transmission, the facsimile board 103 receives image data in response to a facsimile call from the communication line, and drives the engine 113 to print out an image according to the image data thus received.

The communication I/F 116 connects the bus 117 and various external device networks connected to the image forming apparatus 1 for control of the connection.

The PC 2 is connected to the image forming apparatus 1 via the communication I/F 116 to transfer, e.g., image data and margin setting information.

In such a hardware structure, the RAM 111 retrieves programs stored in storage media such as the ROM 112, the HDD 114, and an optical disk. The CPU 110 performs a calculation according to the program read into the RAM 111, thereby constructing a software controller. A combination of the software controller and the hardware configured as described above constructs the functional block diagrams of FIGS. 5 through 7 illustrating functions of the image forming apparatus 1 according to the present embodiment.

Figure 13:
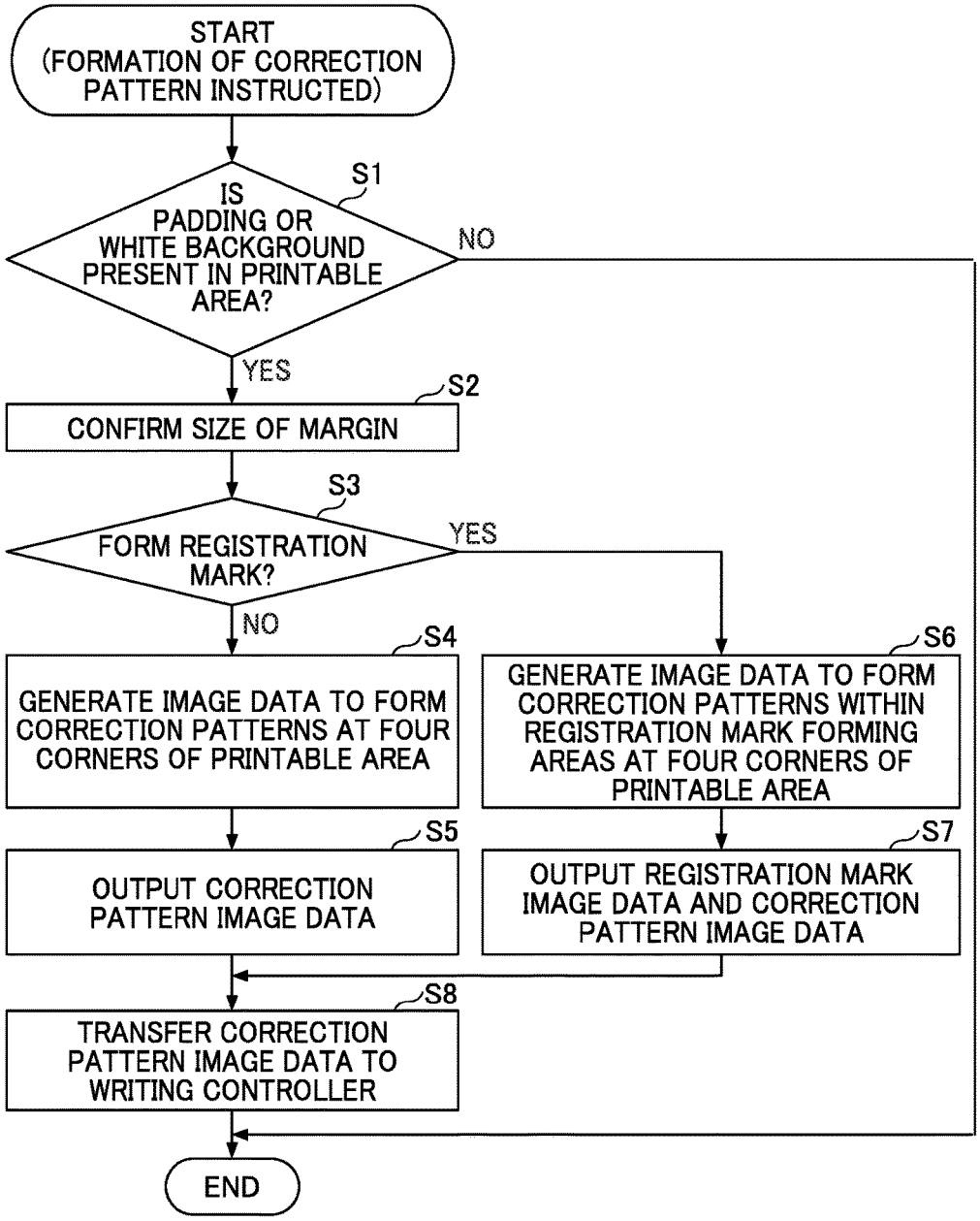
FIG. 13 is a flowchart of a process of generating and outputting image data of a correction pattern.

Referring now to FIG. 13, a description is given of a process of forming a correction pattern, particularly a process of generating and outputting image data of the correction pattern executed by the correction pattern image processor 93.

FIG. 13 is a flowchart of the process of generating and outputting image data of the correction pattern.

Figure 15A:
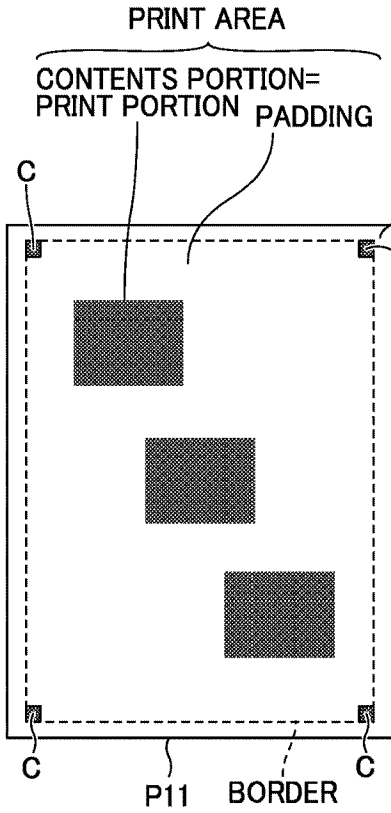
FIG. 15A is a plan view of a sheet bearing a plurality of solid images.
Figure 15B:
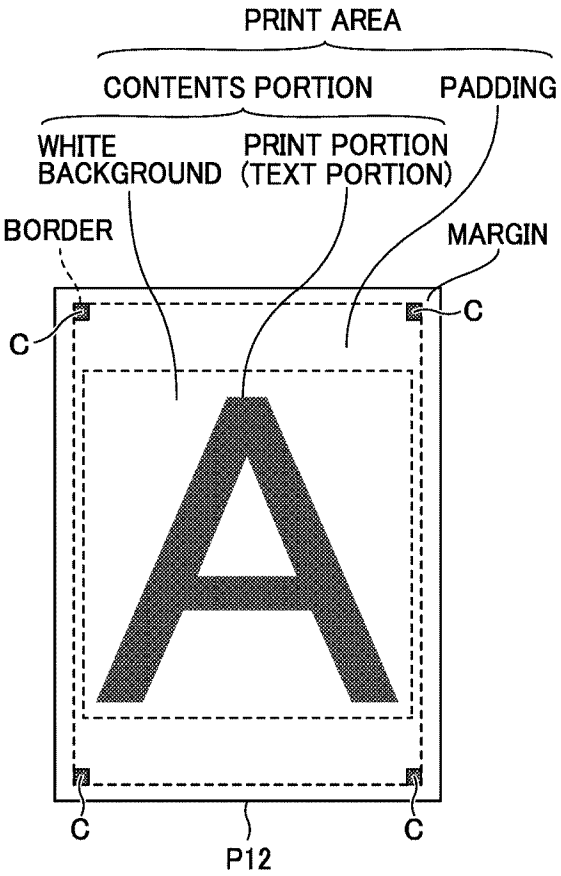
FIG. 15B is a plan view of a sheet bearing an image including a white portion.

In response to an instruction of forming a correction pattern, the margin information extractor 931 checks the image data to determine whether a padding (i.e., inner margin) or a white background, illustrated in FIG. 15B, is present in the printable area in step S1.

Figure 15C:
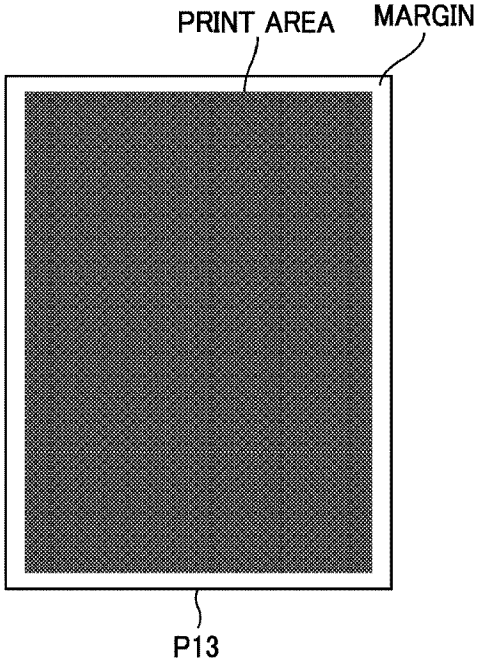
FIG. 15C is a plan view of a sheet bearing a solid image in an entire print area.

If neither the padding nor the white background is present as illustrated in FIG. 15C ("NO" in step S1), the process ends without forming a correction pattern, as "correction pattern cannot be formed".

By contrast, if at least one of the padding and the white background is present in the printable area ("YES" in step S1), the margin information extractor 931 confirms the size (e.g., predetermined width) of the margin (i.e., outer margin) in step S2.

In step S3, it is confirmed whether to form registration marks.

If the registration marks are not formed ("NO" in step S3), the correction pattern position setter 932 sets or generates image data to form correction patterns at four corners of the printable area in step S4. The printable area is located inside the margin (i.e., outer margin) confirmed in step S2 on a sheet P. As illustrated in FIGS. 15A and 15B, the four corners of the printable area correspond to portions located inside the printable area, immediately adjacent to the border of the printable area or print area. The border is a boundary between the printable area and the margin (i.e., outer margin).

In step S5, the correction pattern position setter 932 outputs the image data (herein referred to as correction pattern image data) thus generated to the system controller 91. Then, the system controller 91 transfers the correction pattern image data to the LD controller 74 of the writing controller 70 via the line memory 80 in step S8.

By contrast, if the registration marks are formed ("YES" in step S3), the correction pattern position setter 932 sets or generates registration mark image data and correction pattern image data to form correction patterns within areas in which the registration marks are formed, at four corners of the printable area in step S6. As described above, the printable area is located inside the margin (i.e., outer margin) confirmed in step S2 on a sheet P.

In step S7, the correction pattern position setter 932 outputs the registration mark image data and the correction pattern image data thus generated to the system controller 91. Then, the system controller 91 transfers the registration mark image data and the correction pattern image data to the LD controller 74 of the writing controller 70 via the line memory 80 in step S8.

The LD controller 74 of the writing controller 70 drives and controls the LD 211 of the light beam scanner 21, serving as an optical writer, according to the image data thus transferred in step S8. Thus, the process described above ends, as followed by image forming process including writing a latent image on the surface of the photoconductive drum 40.

Typically, to align images on both the front and back sides of a recording medium, correction marks are formed on both sides of a test recording medium, which is not used as a recording medium on which a print image subjected to printing is formed. That is, the image forming operation is temporarily halted simply to correct image misalignment by use of the test recording medium.

Hence, in the present embodiment, the correction marks are formed on a recording medium together with the print image, thereby detecting an image forming position without temporarily halting the image forming operation.

Figure 14B:
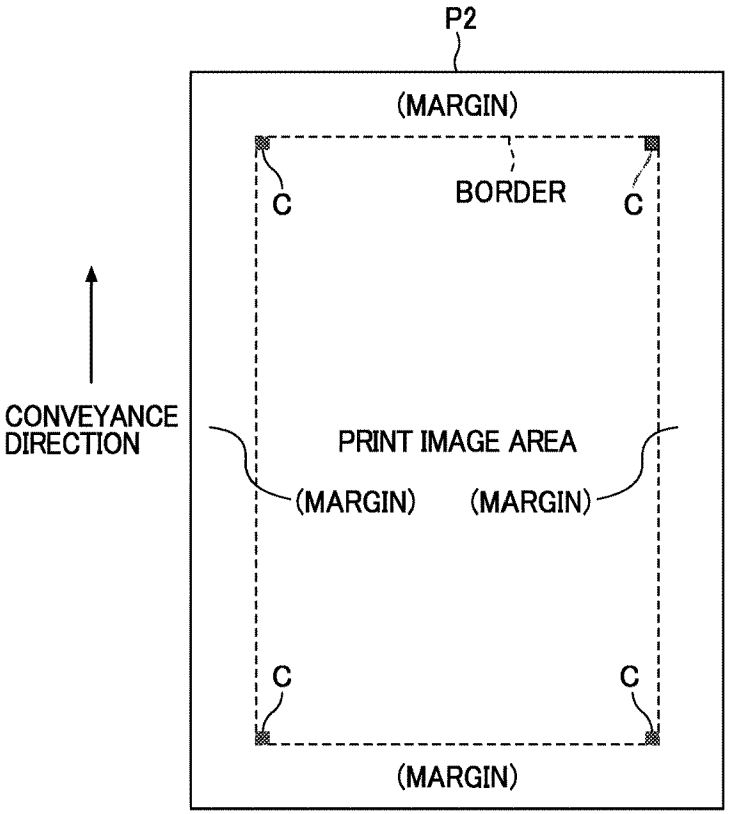
FIG. 14B is a plan view of a sheet bearing image displacement correction patterns with a variation of the standard margin.
Figure 14A:
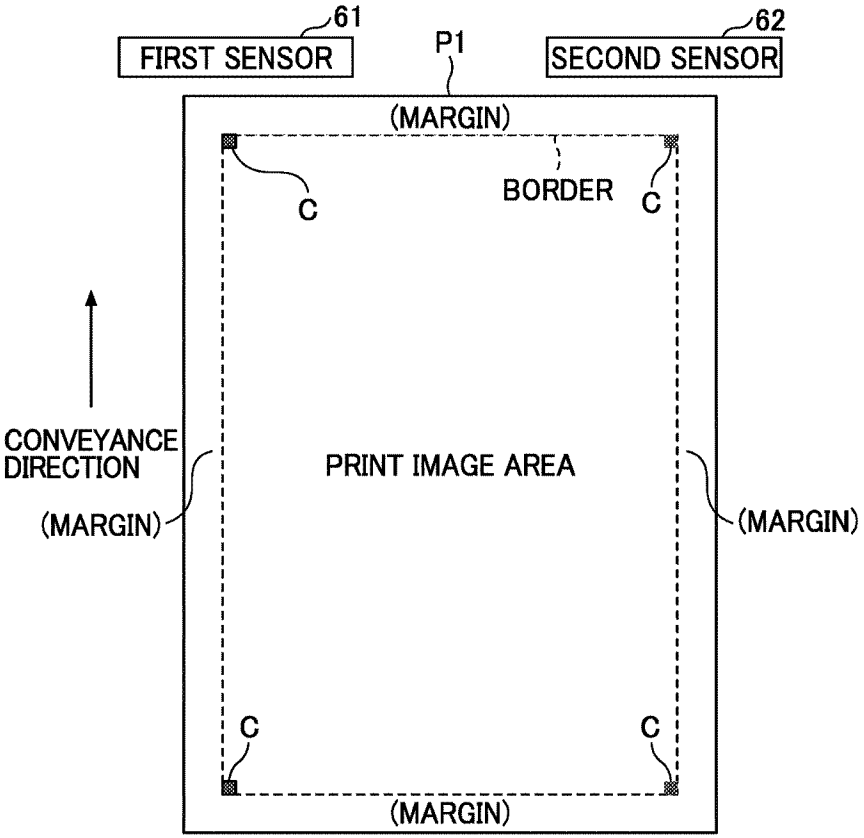
FIG. 14A is a plan view of a sheet bearing image displacement correction patterns with a standard margin.

Referring now to FIGS. 14A and 14B, a description is given of the image displacement correction pattern.

FIGS. 14A and 14B illustrate the image displacement correction patterns. Specifically, FIG. 14A is a plan view of a sheet P1 bearing image displacement correction patterns C with a standard margin. FIG. 14B is a plan view of a sheet P2 bearing the image displacement correction patterns C with a changed margin, that is, a variation of the standard margin.

On the surface (e.g., front side) of each of the sheet P1 and the sheet P2, the image displacement correction pattern C is formed at each of four corner end portions of a print image area. That is, the image displacement correction patterns are added to a print image, which is at least one of text and image to be printed. More specifically, a toner image is formed on a recording medium, according to image data of at least one of text and image to be printed and image data of the correction patterns.

As illustrated in FIG. 14A, for example, the first sensor 61 and the second sensor 62 detect the toner image of the image displacement correction patterns C (hereinafter also referred to as correction pattern images C), as the sheet P1 moves along the conveyance direction (i.e., sheet conveyance direction). The readings of the first sensor 61 and the second sensor 62 are sent to the printer controller 90, which calculates the position of the correction pattern image C relative to an edge of the sheet P1.

Specifically, as described above, the printer controller 90 compares the readings with an ideal pattern position (i.e., ideal value). Then, the printer controller 90 calculates the control data (i.e., the image position in the main scanning direction, the image magnification, the image position in the sub-scanning direction, and the correction value of the image magnification). Then, the printer controller 90 sends and sets the control data to the writing start position controller 72, the pixel clock generator 71, and the polygon motor controller 75, described above with reference to FIG. 5A, in synchronization with formation of a toner image on the back side of the sheet P1.

Although FIGS. 14A and 14B illustrate quadrilateral correction pattern images C, the correction pattern image C may be formed in any other shape provided that the position thereof is detectable both in the main scanning direction and in the sub-scanning direction with respect to the sheet P (e.g., sheet P1, sheet P2). For example, the correction pattern image C may have a shape in combination of lateral and vertical lines. Preferably, the correction pattern image C is as small as possible so as to be inconspicuous, provided that the correction pattern image C is detectable.

The correction pattern image C is formed preferably in black, considering the color of the sheet P, which is usually white, and also considering monochrome printing. However, to ensure that the correction pattern image C is detectable on the sheet P even if the sheet P is colored paper, the color of the correction pattern image C is desirably changed depending on the color of the sheet P such that the correction pattern image is detectable on any color of the sheet P.

In the example of FIG. 14A, the first sensor 61 and the second sensor 62 detect the correction pattern images C on the sheet P1. Alternatively, a single sensor having a length along an entire width of the sheet P1 may be employed to detect all the correction pattern images C. That is, regardless of the width of the sheet P, the sensor or sensors are employed to detect all the correction pattern images C.

As described above, in the present embodiment, the correction patterns are formed together with the print image (i.e., at least one of text and image to be printed) as a toner image on the recording medium. Accordingly, the correction patterns are visible upon printing while barely affecting the print image.

Referring now to FIG. 14B, the sheet P2 has an increased margin (i.e., outer margin) compared to the margin of the sheet P1 illustrated in FIG. 14A. In short, the sheet P2 has a margin greater than the margin of the sheet P1. As the margin is increased, the position of the correction pattern images C moves inward by an amount corresponding to the increase in the margin.

The margin may be changed depending on, e.g., the type of the sheet P (i.e., recording medium). For example, if the sheet P is thin paper, the margin is increased because the sheet P may be easily wound around the fixing roller 26A. In such a case, the position of the correction pattern images C is also changed in association with the change of the margin.

Thus, by changing the position of the image displacement correction patterns depending on the range of the margin, each of the image displacement correction pattern is formed as close as possible to an end portion of the recording medium, while barely affecting the print image.

Referring now to FIGS. 15A through 15C, a description is given of positions or areas where the image displacement correction patterns can be formed.

FIGS. 15A through 15C illustrate the positions or the areas where the image displacement correction patterns can be formed. Specifically, FIG. 15A is a plan view of a sheet P11 bearing a plurality of solid images. FIG. 15B is a plan view of a sheet P12 bearing an image including a white portion. FIG. 15C is a plan view of a sheet P13 bearing a solid image in an entire print area.

Note that, elements in printing on the sheet P (e.g., sheet P11, sheet P12, sheet P13), herein include, e.g., the margin, the border, contents portion, and the padding. The margin is an outer blank space on the sheet P. The border is an outer frame or a boundary that specifies the print area. The contents portion is an element forming portion subjected to formation of at least one of text and image inside the border, that is, in the print area. The padding is an interval between the margin and the contents portion. In other words, the padding is an inner margin or a blank space inside the border but is not included in the contents portion.

The print area is a printable area inside the border, that is, an area except the margin (i.e., outer margin) on the sheet P. In the print area, at least one of text and image is formed. The print area is herein referred to as the printable area or the print image area.

The contents portion is a portion other than the padding (i.e., inner margin) in the print area. Upon formation of at least one of image and text, the contents portion is not recognized for each character, for example. Instead, each element is specified as a predetermined group, for example, as a group for each particular content (i.e., content-box), except for the padding (i.e., inner margin).

If solid images (i.e., images without white portions) are printed on the sheet P11 as illustrated in FIG. 15A, the contents portion is equal to the print portion. If text is formed on the sheet P12 such as a character as illustrated in FIG. 15B, the contents portion includes the print portion (i.e., text portion) and the white background.

The print portion is a toner image forming portion where toner is attached to form at least one of text and image. As illustrated in FIG. 15B, upon formation of a character or an image including a white portion (e.g., black and white line drawing), the print portion is smaller than the contents portion because the contents portion includes the white background to which toner is not attached, in addition to the print portion.

In the present embodiment, the correction pattern image C can be formed in the padding (i.e., inner margin) or the white background, but not in the margin (i.e., outer margin). That is, in the print area of the sheet P, the correction pattern image C (i.e., toner image of image displacement correction pattern) is formed in the blank portion, which is a portion other than the print portion where the toner image of at least one of the text and image is formed.

If a solid image is formed in the entire print area as illustrated in FIG. 15C, the print area is equal to the contents portion and is also equal to the print portion (i.e., print area=contents portion=print portion). In such a case, in the present embodiment, no correction pattern is basically formed on the sheet P13 of FIG. 15C.

Alternatively, the system controller 91 may output an instruction to forcibly add an inner margin inside the margin (i.e., outer margin). For example, upon formation of a solid image as illustrated in FIG. 15C, upper and lower edges, right and left edges, or four side edges of the solid image along the border line adjacent to the margin, or the four corners of the solid image may be forcibly masked to form inner margins or white backgrounds, so as to form correction pattern images C at the masked portions.

Figure 16B:
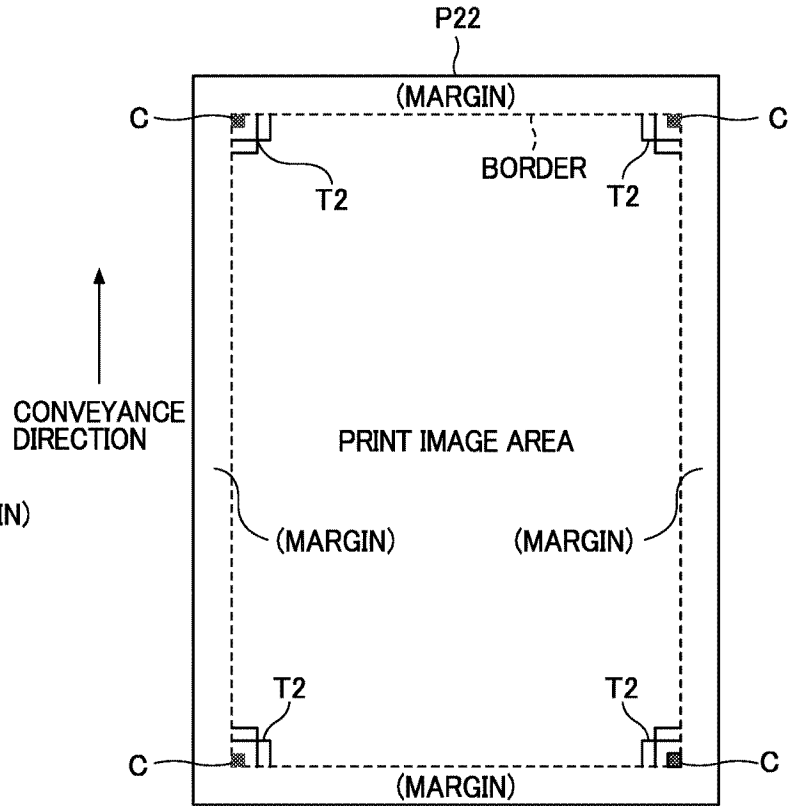
FIG. 16B is a plan view of a sheet bearing the image displacement correction patterns and unique registration marks.
Figure 16A:
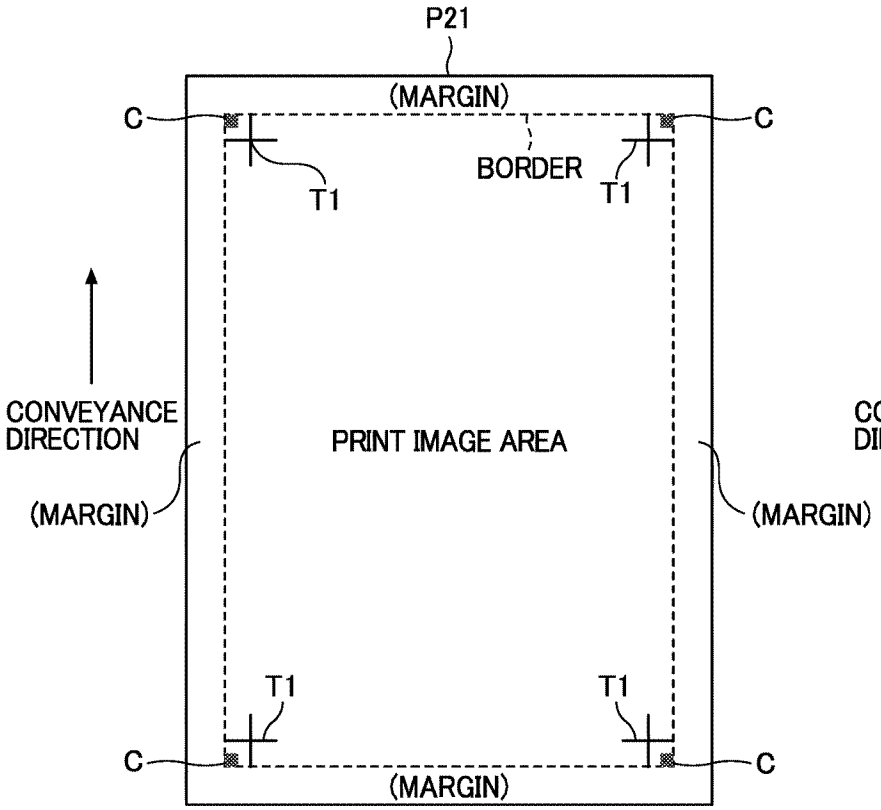
FIG. 16A is a plan view of a sheet bearing the image displacement correction patterns and standard registration marks.

Referring now to FIGS. 16A and 16B, a description is given of the image displacement correction patterns formed with the registration marks.

FIGS. 16A and 16B illustrate the correction pattern images C formed with registration marks. Specifically, FIG. 16A is a plan view of a sheet P21 bearing the correction pattern images C and standard registration marks T1. FIG. 16B is a plan view of a sheet P22 bearing the correction pattern images C and unique registration marks T2.

Unlike FIGS. 14A and 14B, FIGS. 16A and 16B illustrate registration marks on the sheet P21 and the sheet P22, respectively. Specifically, in FIG. 16A, the standard registration marks T1 are formed at four corners of the print image area on the sheet P21. In FIG. 16B, the unique registration marks T2 are formed at four corners of the print image area on the sheet P22. As illustrated in FIGS. 16A and 16B, the print image is not formed at the four corners of the print image area, at which the registration marks T1 and T2 are formed, in the print image area. Therefore, the correction pattern images C are formed at the four corners of the print image area, to correct an image position without affecting the print image (i.e., print portion).

FIG. 16B illustrates the unique registration marks T2 having a different shape from a shape of the registration marks T1 illustrated in FIG. 16A. The registration marks are not limited to the registration marks T1 and T2. In FIG. 16B, the correction pattern images C are formed in areas where the unique registration marks T2 are formed and where the print image is not formed. Other than the formation of the registration marks, FIGS. 16A and 16B illustrate identical configurations.

Thus, in the present embodiment, the image displacement correction patterns are formed in the areas where the registration marks T1 or T2 are formed without affecting the print image.

Figure 17A:
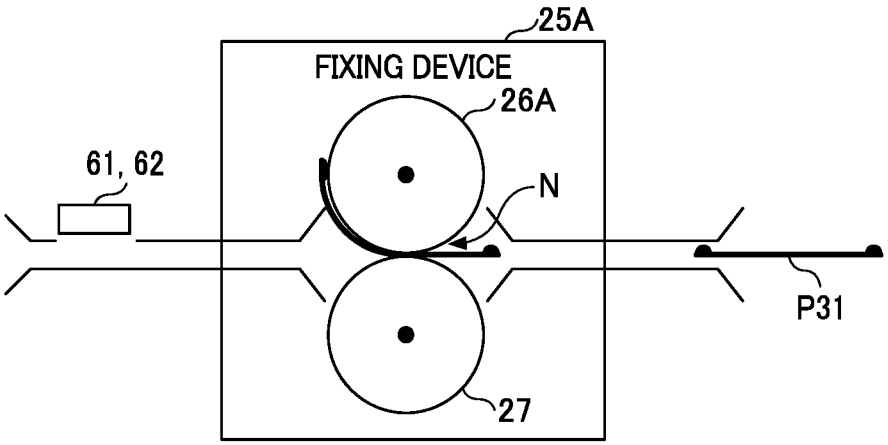
FIG. 17A is a schematic view of the fixing device, illustrating how a sheet bearing a correction pattern on a margin is conveyed in the fixing device.
Figure 17B:
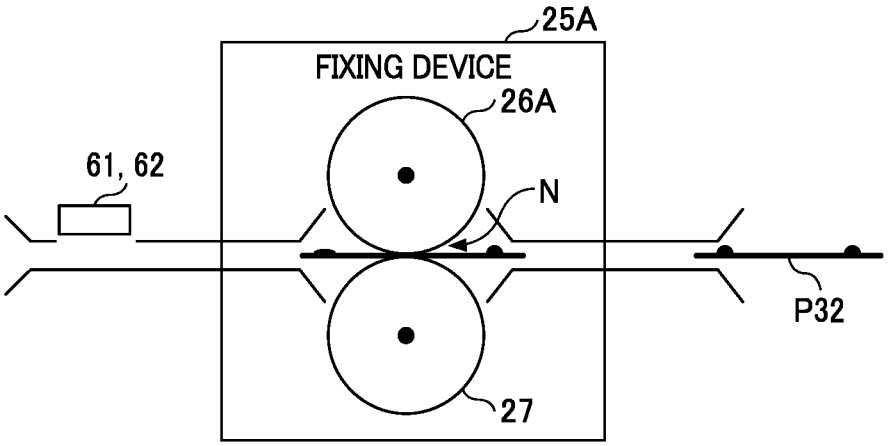
FIG. 17B is a schematic view of the fixing device, illustrating how a sheet bearing a correction pattern in a print area is conveyed in the fixing device.

Referring now to FIGS. 17A and 17B, a description is given of the sheet P bearing a correction pattern (i.e., image displacement correction pattern) conveyed through the fixing device 25A.

FIGS. 17A and 17B illustrate how two sheets bearing correction patterns in a different way are conveyed through the fixing device 25A. Specifically, FIG. 17A is a schematic view of the fixing device 25A, illustrating how a sheet P31 is conveyed in the fixing device 25A. The sheet P31 bears a correction pattern on a margin located on a leading end of the sheet P31 in a conveyance direction of the sheet P31. FIG. 17B is a schematic view of the fixing device 25A, illustrating how a sheet P32 is conveyed in the fixing device 25A. The sheet P32 bears a correction pattern in the print area of the sheet P32.

As illustrated in FIG. 17A, when the sheet P31 bearing a toner image of the correction pattern formed on the margin on the leading end of the sheet P31 in the conveyance direction thereof is conveyed through the fixing nip N, the pressure roller 27 presses the sheet P31 against the fixing roller 26A while the toner contained in the toner image melts under heat. The pressure applied to the sheet P31 from above and below may excessively melt the toner, thereby facilitating the sheet P31 to be wound around the fixing roller 26A. More specifically, when the sheet P31 enters the fixing nip N and starts being pressed, the sheet P31 receives a greater load than the load to which the sheet P31 is subjected after the sheet P31 enters the fixing nip N, where a constant pressure is applied to the sheet P31. Such a greater load facilitates the toner of the toner image formed on the sheet P31 to adhere to the fixing roller 26A that comes into direct pressure contact with the sheet P31. As the toner image of the correction pattern is formed on the margin on the leading end of the sheet P31 in the conveyance direction thereof, the toner of the toner image adhering to the fixing roller 26A may wind the sheet P31 around the fixing roller 26A.

By contrast, as illustrated in FIG. 17B, the toner image of the correction pattern is formed in the print area, not on a margin located on a leading end of the sheet P32 in the conveyance direction thereof. That is, at the moment when the sheet P32 enters the fixing nip N, the toner image of the correction pattern does not come into contact with the fixing roller 26A. The toner image of the correction pattern passes through the fixing nip N while a constant pressure is applied to the sheet P32. In other words, the toner image comes into direct pressure contact with the fixing roller 26A while the sheet P32 receives a less load than the load to which the sheet P32 is subjected when the sheet P32 enters the fixing nip N.

Since the toner image of the correction pattern is formed in the print area of the sheet P32, the toner image of the correction pattern and a toner image of the print image (i.e., print portion) may adhere to the fixing roller 26A, which is in direct pressure contact with the toner images on the sheet P32, with identical adhesion forces. In short, the toner image of the correction pattern may adhere to the fixing roller 26A similarly to the toner image of the print image that may adhere to the fixing roller 26A during normal image formation. Accordingly, in the present embodiment, the toner image of the correction pattern formed in the print area prevents the sheet P32 from being wound around the fixing roller 26A.

Figure 18:
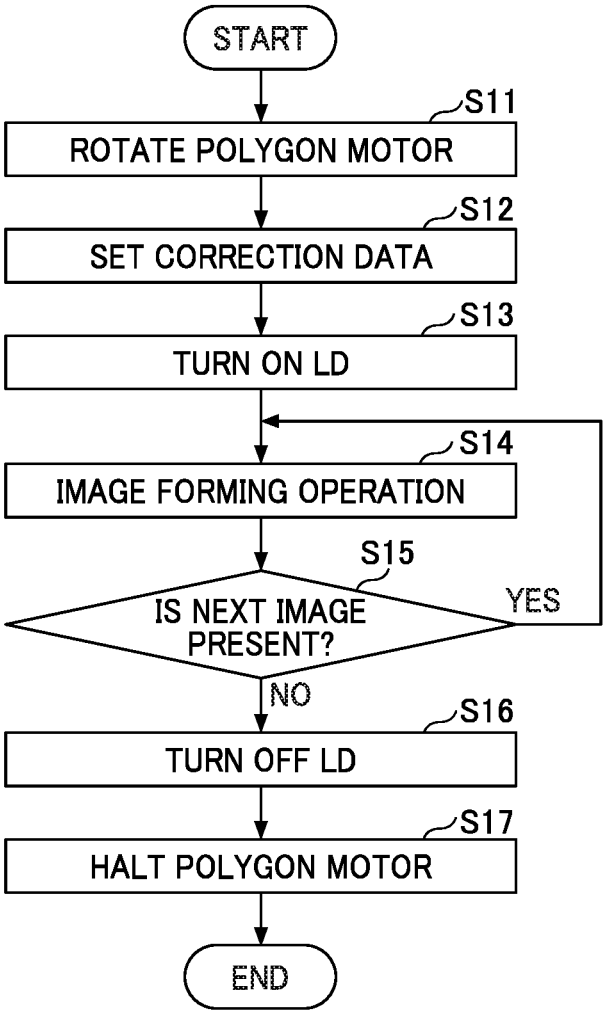
FIG. 18 is a flowchart of an entire process of an image forming operation executed in the image forming apparatus of FIG. 1.

Referring now to FIG. 18, a description is given of an entire process of an image forming operation executed in the image forming apparatus 1.

FIG. 18 is a flowchart of the entire process of the image forming operation executed in the image forming apparatus 1.

The flow starts with a print job starting operation in response to, e.g., an instruction through a control panel included in the operation display 101 or the PC 2 connected to the image forming apparatus 1 ("START" in FIG. 18).

In step S11, the polygon motor is rotated at the rotation speed instructed by the printer controller 90 so as to rotate the polygon mirror 213.

In step S12, the image forming apparatus 1 inputs correction data to the printer controller 90 to set the correction data. Specifically, in step S12, the system controller 91 retrieves correction data stored in the control data storage 95 as illustrated in FIG. 11. The correction data includes, e.g., correction data detected from the surface of a sheet P or correction data obtained by averaging correction data detected from a plurality of sheets P.

In step S13, the LD controller 74 turns on the LD 211 as a light source. Specifically, for example, the LD controller 74 turns on the LD 211 according to the LD forced lighting signal BD and performs an auto power control (APC) operation such that the LD 211 to emit a predetermined amount of light for each color.

In step S14, the image forming apparatus 1 performs image formation. Specifically, according to image data inputted into the image forming apparatus 1, a latent image is written on the photoconductive drum 40 under control of the LD 211 by the LD controller 74 illustrated in FIG. 5A, for example. The latent image is rendered visible as a toner image. The toner image is transferred indirectly onto the sheet P in the present embodiment, thus being formed on the sheet P as a toner image of a print image subjected to printing. Optionally, together with the toner image of the print image, a toner image of image displacement correction patterns may be formed on the sheet P to detect and correct an image position.

In step S15, the image forming apparatus 1 determines whether a next image is present. If the image forming apparatus 1 determines that the next image is present ("YES" in step S15), the process returns to step S14 to form the next image. If the image forming apparatus 1 determines that the next image is not present ("NO" in step S15), the process proceeds to step S16.

In step S16, the LD controller 74 turns off the LD 211.

In step S17, the polygon motor controller 75 halts the polygon motor that rotates the polygon mirror 213 illustrated in FIG. 4. Thus, the entire process ends ("END" illustrated in FIG. 18).

Figure 19:
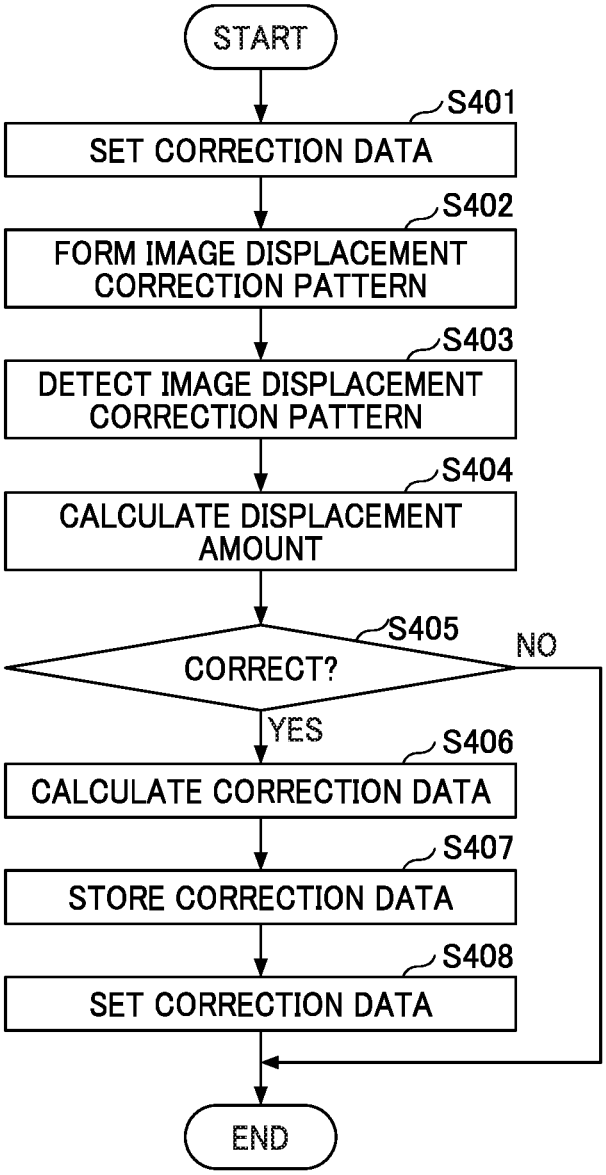
FIG. 19 is a flowchart of control for reflecting image displacement detection results as correction data.

Referring now to FIG. 19, a description is given of a flow of correcting an image displacement.

FIG. 19 is a flowchart of control for reflecting image displacement detection results as correction data.

The control flow is executed during the image forming operation of FIG. 18, for example.

In S401, the correction data stored in the control data storage 95 is set to the associated controllers described above, if the correction data is not set when the image forming apparatus 1 is turned on. The correction data is latest first surface correction data. Note that the first surface is the front side of the sheet P.

Thereafter, in step S402, a duplex printing operation starts. At the same time when a toner image of a print image is formed on the first surface (i.e., front side) of the sheet P, a toner image of image displacement correction patterns is formed on the sheet P following the process illustrated in FIG. 13.

In step S403, the first sensor 61 and the second sensor 62 disposed at the exit of the fixing device 25 detect the image displacement correction patterns formed in step S402 and send the readings to the displacement amount calculator 941.

In step S404, the displacement amount calculator 941 calculates a displacement amount with respect to an ideal value. In step S405, the displacement amount calculator 941 determines whether correction is to be performed. For example, if the displacement amount is equal to or greater than half a correction resolution, the displacement amount calculator 941 determines that correction is to be performed.

If the displacement amount calculator 941 determines that the correction is to be performed ("YES" in step S405), then, the correction amount calculator 942 calculates correction data (i.e., control data) in step S406. In step S407, the correction data in the control data storage 95 is updated. That is, the correction data stored in the control data storage 95 is replaced with the new correction data thus calculated in step S406. Thus, the control data storage 95 stores the updated correction data. In step S408, the updated correction data is set to the associated controllers of the writing controller 70 to form an image on a second surface (i.e., back side) of the sheet P.

Note that, in the present embodiment, the correction data includes: a value of the pixel clock frequency for determining image magnification in the main scanning direction; a value of the main scanning control signal XRGATE for determining an image position in the main scanning direction; a value of the sub-scanning control signal XFGATE for determining an image position in the sub-scanning direction;

and a value of the rotation speed of the polygon motor for determining image magnification in the sub-scanning direction.

By contrast, if the displacement amount calculator 941 determines that the correction is not to be performed ("NO" in step S405), then, the process ends without updating the correction data stored in the control data storage 95. The same control flow is applied to the next and subsequent sheets P.

When correction is performed and correction data is calculated for the next and subsequent sheets P, the correction data of the first surface (i.e., front side) and the correction data of the second surface (i.e., back side) stored in the control data storage 95 are updated in step S407 and set again in step S408.

In the present embodiment, the displacement correction is applied to the alignment between the front side and the back side of the sheet P. In addition, the displacement correction can be applied to continuous printing by reflecting the detection results of a recording medium to a next recording medium.

The control flow described above is employed to the image displacement correction of the first surface (i.e., front side). However, unlike the correction on the second surface (i.e., back side), a real-time correction may not be made in some cases. For example, the real-time correction may not be made when a correction pattern formed on a first recording medium is detected at the same time when an image is formed on a second recording medium.

In such a case, since the detection results of the first surface of the first recording medium are not fed back to the first surface of the second recording medium, the correction value may be fed back to an image of a subsequent recording medium. In that case, preferably, an average value of the detection results of some recording media is used. By storing the correction data in the control data storage 95, the latest correction data remains available.

When a solid image is formed on the entire printable area as illustrated in FIG. 15C, the correction pattern is not formed in the printable area. In such a case, the correction data stored in the control data storage 95 is used.

The image displacement correction illustrated in FIG. 19 is performed upon duplex printing, for example. The image displacement correction may be performed as a default. Alternatively, the image displacement correction may be performed in response to an instruction through the control panel, for example.

As described above, according to an embodiment of the present disclosure, a toner image of an image displacement correction pattern is formed at each of four corners of an image area of a recording medium. Each of the four corners of the image area is a corner of an extreme end portion of the image area that borders a margin. In other words, the toner image of the image displacement correction pattern is formed at each of the four corners of the print area such that at least a part of the toner image is immediately adjacent to or overlaps the boundary between the margin and the image area in which at least one of text and image is formed. As the toner image of the image displacement correction pattern is formed in the image area, the recording medium bearing the toner image is not wound around a fixing rotator (e.g., fixing roller 26A), thereby preventing a paper jam, upon detection of an image forming position without interrupting a printing operation. In addition, the toner image of the image displacement correction pattern barely affect a print image including at least one of text and image to be printed.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

Any one of the above-described operations may be performed in various other ways, for example, in an order different from that described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disks, hard disks, optical discs, magneto-optical discs, magnetic tapes, non-volatile memory cards, read only memories (ROMs), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An image forming apparatus comprising:

at least one photoconductor;

an optical writer including a light source configured to emit light to write an electrostatic latent image on the at least one photoconductor;

an image data generator configured to, determine, based on original image data, a range of a margin by analyzing whether a blank portion corresponding to an inner margin will be present within a printable area corresponding to an outside margin, generate, based on the original image data, image data of at least one of text and image and image data of a correction pattern for image displacement correction, the correction pattern including at least two edges in each of a main scanning direction and a sub-scanning direction, and selectively change the image data of the correction pattern to change a position at which the correction pattern is formed inside the outside margin, based on the range of the margin;

a light emission controller configured to control the light source to cause the optical writer to form the electrostatic latent image corresponding to the image data generated by the image data generator;

a conveyor configured to convey a recording medium;

a developing device configured to develop the electrostatic latent image with toner to form a toner image on the at least one photoconductor, the toner image including a toner image of the correction pattern;

a transfer device configured to transfer the toner image from the at least one photoconductor onto the recording medium conveyed by the conveyor;

a fixing device configured to fix the toner image including the correction pattern onto the recording medium such that the correction pattern is formed at each of at least four corners between the inside margin and the outside margin adjacent to an end portion of the recording medium, the fixing device including, a fixing rotator configured to press against a surface of the recording medium bearing the toner image, and a pressure rotator configured to press against the fixing rotator to form a fixing nip between the fixing rotator and the pressure rotator, through which the recording medium is conveyed;

a detector disposed downstream from the fixing nip in a direction of conveyance of the recording medium, the detector configured to detect the toner image of the correction pattern fixed onto the recording medium; and a writing position controller configured to control a time when the light source emits light to correct a position at which the electrostatic latent image is written on the at least one photoconductor, based on the toner image of the correction pattern detected by the detector.

2. The image forming apparatus according to claim 1, further comprising:

an intermediate transferor, wherein the transfer device is configured to transfer the toner image from the at least one photoconductor onto the recording medium via the intermediate transferor.

3. The image forming apparatus according to claim 1, wherein the toner image of the correction pattern is formed in an area in which a registration mark is formed as a mark for a post process, on the recording medium.

4. The image forming apparatus according to claim 1, wherein a part of the toner image of the correction pattern is formed to overlap a boundary between the margin and an area in which the at least one of text and image is formed on the recording medium.

5. The image forming apparatus according to claim 1, wherein a part of the toner image of the correction pattern is formed in a blank portion of an area in which the at least one of text and image is formed on the recording medium, and the blank portion does not include a toner image of the at least one of text and image.

6. The image forming apparatus of claim 1, wherein the image data generator is configured to, generate control data based on a displacement determined from the toner image of the correction pattern, the control data including an image position in the main scanning direction, an image magnification, an image position in the sub-scanning direction and a correction value of the image magnification, store the control data in a memory, and control the time when the light source emits light by reading the control data from the memory.

7. The image forming apparatus of claim 1, wherein the image data generator is configured to generate the image data of the correction pattern such that, if the image data includes a registration mark, the at least two edges of the correction pattern are aligned with corresponding ends of the registration mark.

8. An image forming apparatus comprising:

a detector disposed downstream from a fixing nip of a fixing device in a direction of conveyance of a recording medium, the detector configured to detect a correction pattern included in a toner image fixed onto the recording medium; and at least one controller configured to, determine, based on original image data, a range of a margin by analyzing whether a blank portion corresponding to an inner margin will be present within a printable area corresponding to an outside margin, generate, based on the original image data, printable image data, the printable image data including image data received from a host and the correction pattern for image displacement correction, the correction pattern including at least two edges in each of a main scanning direction and a sub-scanning direction, selectively modify the printable image data including the correction pattern to change a position at which the correction pattern is formed inside the outside margin based on the range of the margin, instruct the image forming apparatus to generate the toner image including the correction pattern and transfer same to the recording medium such that the correction pattern is formed at each of at least four corners between the inside margin and the outside margin adjacent to an end portion of the recording medium, and control a time when the light source emits light to correct a position at which an electrostatic latent image is written by an optical writer on at least one photoconductor based on the toner image of the correction pattern detected by the detector.

9. The image forming apparatus of claim 8, wherein the at least one controller is configured to generate the image data of the correction pattern such that, if the image data includes a registration mark, the at least two edges of the correction pattern are aligned with corresponding ends of the registration mark.

10. An image forming apparatus comprising:

a detector disposed downstream from a fixing nip of a fixing device in a direction of conveyance of a recording medium, the detector configured to detect a correction pattern included in a toner image fixed onto the recording medium; and at least one controller configured to, determine, based on original image data, a range of a margin by analyzing whether a blank portion corresponding to an inner margin will be present within a printable area corresponding to an outside margin, generate, based on the original image data, printable image data, the printable image data including image data received from a host and the correction pattern for image displacement correction, the correction pattern including at least two edges in each of a main scanning direction and a sub-scanning direction, instruct the image forming apparatus to generate the toner image including the correction pattern and transfer same to the recording medium such that the correction pattern is formed at each of at least four corners between the inside margin and the outside margin adjacent to an end portion of the recording medium, generate control data based on a displacement determined from the toner image of the correction pattern, the control data including an image position in the main scanning direction, an image magnification, an image position in the sub-scanning direction and a correction value of the image magnification, store the control data in a memory, and control a time when the light source emits light by reading the control data from the memory to correct a position at which an electrostatic latent image is written by an optical writer on at least one photoconductor based on the toner image of the correction pattern detected by the detector.

11. An image forming apparatus comprising:

at least one photoconductor;

an optical writer including a light source configured to emit light to write an electrostatic latent image on the at least one photoconductor;

an image data generator configured to, determine, based on original image data, a range of a margin by analyzing whether a blank portion corresponding to an inner margin will be present within a printable area corresponding to an outside margin, and generate, based on the original image data, image data of at least one of text and image and image data of a correction pattern for image displacement correction, the correction pattern including at least two edges in each of a main scanning direction and a sub-scanning direction;

a light emission controller configured to control the light source to cause the optical writer to form the electrostatic latent image corresponding to the image data generated by the image data generator;

a conveyor configured to convey a recording medium;

a developing device configured to develop the electrostatic latent image with toner to form a toner image on the at least one photoconductor, the toner image including a toner image of the correction pattern;

a transfer device configured to transfer the toner image from the at least one photoconductor onto the recording medium conveyed by the conveyor;

a fixing device configured to fix the toner image including the correction pattern onto the recording medium such that the correction pattern is formed at each of at least four corners between the inside margin and the outside margin adjacent to an end portion of the recording medium, the fixing device including, a fixing rotator configured to press against a surface of the recording medium bearing the toner image, and a pressure rotator configured to press against the fixing rotator to form a fixing nip between the fixing rotator and the pressure rotator, through which the recording medium is conveyed;

a detector disposed downstream from the fixing nip in a direction of conveyance of the recording medium, the detector configured to detect the toner image of the correction pattern fixed onto the recording medium; and a writing position controller configured to control a time when the light source emits light to correct a position at which the electrostatic latent image is written on the at least one photoconductor, based on the toner image of the correction pattern detected by the detector, wherein the image data generator is configured to, generate control data based on a displacement determined from the toner image of the correction pattern, the control data including an image position in the main scanning direction, an image magnification, an image position in the sub-scanning direction and a correction value of the image magnification, store the control data in a memory, and control the time when the light source emits light by reading the control data from the memory.

* * * * *